US010739715B2

(12) United States Patent
Kudo

(10) Patent No.: US 10,739,715 B2
(45) Date of Patent: Aug. 11, 2020

(54) IMAGE FORMING APPARATUS

(71) Applicant: Oki Data Corporation, Tokyo (JP)

(72) Inventor: Hirotaka Kudo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 198 days.

(21) Appl. No.: 15/847,410

(22) Filed: Dec. 19, 2017

(65) Prior Publication Data

US 2018/0181044 A1 Jun. 28, 2018

(30) Foreign Application Priority Data

Dec. 26, 2016 (JP) ..... 2016-250723

(51) Int. Cl.
*G03G 15/00* (2006.01)
*G03G 15/043* (2006.01)
*G03G 21/14* (2006.01)

(52) U.S. Cl.
CPC ..... *G03G 15/5029* (2013.01); *G03G 15/043* (2013.01); *G03G 15/652* (2013.01); *G03G 15/6591* (2013.01); *G03G 21/14* (2013.01)

(58) Field of Classification Search
CPC ..... G03G 15/5029; G03G 15/043; G03G 15/652; G03G 15/6591; G03G 21/14
See application file for complete search history.

(56) References Cited

U.S. PATENT DOCUMENTS 6,203,131 B1 * 3/2001 Wiklof ..... B41J 3/4075 347/2
2015/0177666 A1 * 6/2015 Numazu ..... B65H 18/026 399/397
2015/0177668 A1 * 6/2015 Numazu ..... B65H 18/026 399/397
2015/0274346 A1 * 10/2015 Buckby ..... B65C 9/1865 156/64

FOREIGN PATENT DOCUMENTS

JP 2003-040229 A 2/2003
JP 2016-177155 A 10/2016

* cited by examiner

*Primary Examiner* — David H Banh
(74) *Attorney, Agent, or Firm* — Muncy, Geissler, Olds & Lowe, P.C.

(57) ABSTRACT

An image forming apparatus includes a conveying unit conveying a recoding medium on which labels are placed, a sensor detecting each of the labels, an image forming unit performing an image forming process at an image forming position, and a control unit adjusting the image forming position for the labels by synchronizing with a cycle with respect to label pitch based on the detection result by the sensor, the cycle with respect to label pitch being determined with a repeating unit that is composed with a predetermined number of the labels that is more than one, and the label pitch being determined by two of the labels adjoining in the conveying direction.

16 Claims, 18 Drawing Sheets

IMAGE FORMING APPARATUS

TECHNICAL FIELD

The present invention relates to an image forming apparatus for forming an image.

BACKGROUND

There are image forming apparatus that are capable of forming an image on a so-called label roll paper on which a plurality of labels are disposed in a roll base sheet (e.g., Patent Document 1).

RELATED ART

[Patent Document] Japanese Patent Laid-Open Publication 2016-177155

In these image forming apparatuses for forming an image on such a label roll paper, it has been desired to form an image in accordance with the position of the label. It is expected to form an image in an appropriate position.

One of the objects of the invention is to provide an image forming apparatus capable of forming an image in a proper position.

SUMMARY

An image forming apparatus comprising: a conveying unit that conveys a recoding medium on which a plurality of labels are placed in a conveying direction, a sensor that detects each of the labels on the recording medium, providing a detection result for each of the labels an image forming unit that performs an image forming process to form an image on one of the labels based on the detection result by the sensor, the image being formed at an image forming position, and a control unit that adjusts the image forming position for the labels by synchronizing with a cycle with respect to label pitch based on the detection result by the sensor, the cycle with respect to label pitch being determined with a repeating unit that is composed with a predetermined number of the labels that is more than one, and the label pitch being determined by two of the labels adjoining in the conveying direction.

Another image forming apparatus disclosed in the application comprises: a conveying unit that conveys a recoding medium on which a plurality of labels are placed in a conveying direction, a sensor that detects each of the labels on the recording medium, providing a detection result for each of the labels an image forming unit that performs an image forming process to form an image on one of the labels based on the detection result by the sensor, the image being formed at an image forming position, and a control unit that adjusts the image forming position for the labels by synchronizing with a cycle of label interval based on the detection result by the sensor, the cycle of label interval being determined with a repeating unit that is composed with a predetermined number of the labels that is more than one, and the label interval being determined by a length between a trailing edge of one label and a leading edge of another label following the one label, these labels adjoining in the conveying direction.

According to the first image forming apparatus in one embodiment of the present invention, in synchronization with the periodicity of label pitches and with the adjustment of the image forming position for each label, the image is formed in an appropriate position. The label pitch may be defined by a sum of a label length of the label, which is measured in the convering direction, and a label interval that is a distance between a trailing edge of one label and a leading edge of the next label following the one label.

According to the second image forming apparatus in another embodiment of the present invention, in synchronization with the periodicity of label intervals and with the adjustment of the image forming position for each label, the image is formed in an appropriate position.

The label pitch, label length and the label interval discussed above are respectively denoted with LP, LL and LS, for example, in FIG. 2 in the application. They satisfies equation (A):

$$LP=LL+LS \quad \text{(A).}$$

DETAILED DESCRIPTION OF PREFERRED EMBODIMENTS

Hereinafter, embodiments of the present invention are explained with reference to the accompanying drawings.

Embodiment

Configuration Example

Figure 1:
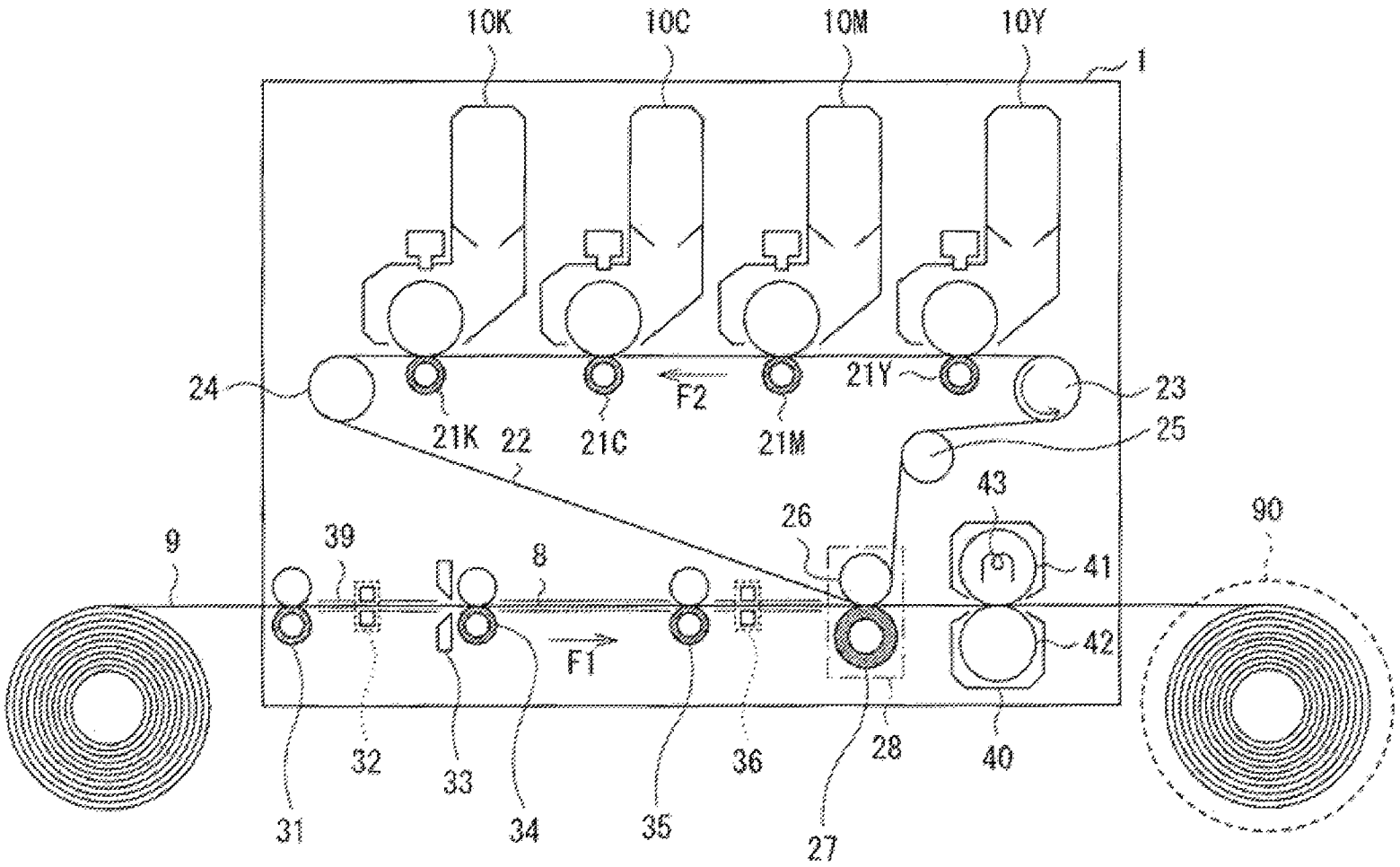
FIG. 1 is an explanatory diagram illustrating a configuration example of an image forming apparatus of the present invention.

FIG. 1 shows a configuration example of an image forming apparatus (image forming apparatus 1) of the present invention. The image forming apparatus 1 forms an image on a recording medium such as a label roll paper using an electrophotographic method, for example.

The image forming apparatus 1 pulls out recording medium 9 from a roll around which the recording medium 9 is wound, forms an image on the recording medium 9. Then, the image forming apparatus 1 supplies rewinder 90 with the recording medium 9 on which the image is formed. The recording medium 9 is wound up by the rewinder 90. That is, the image forming apparatus 1 continuously performs the image forming processing to the recording medium 9, the apparatus performs so-called Roll to Roll printing.

Figure 2:
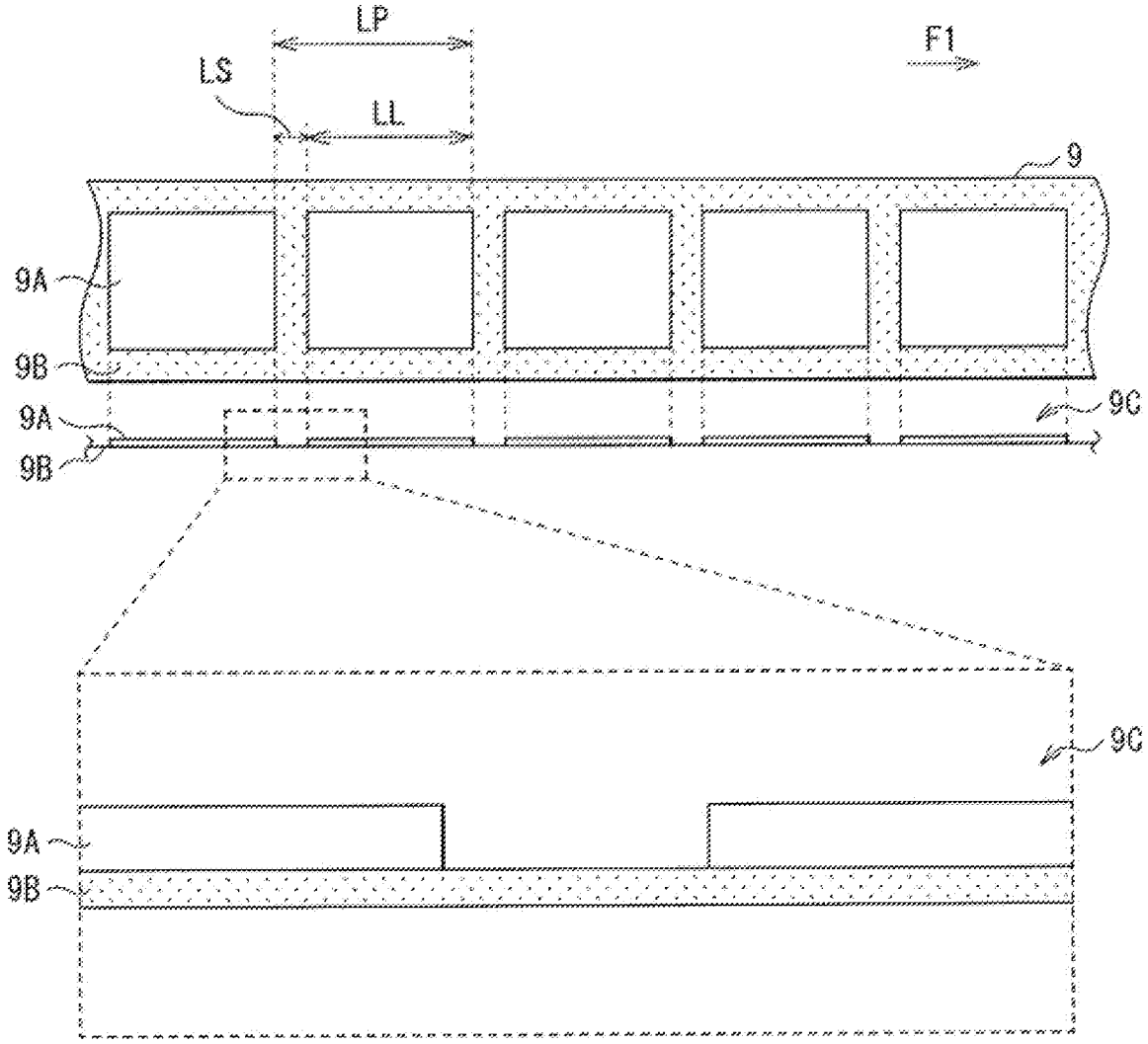
FIG. 2 is an explanatory diagram illustrating a configuration example of a recording medium shown in FIG. 1.

FIG. 2 shows a configuration example of the recording medium 9. The recording medium 9 has a plurality of labels 9A and a base sheet 9B. The label 9A is peeled off from the base sheet 9B and pasted on various objects. A plurality of labels 9A, on the label surface 9C of the recording medium 9, are arranged side by side longitudinally (or lateral direction in FIG. 2) with label pitches LP of the recording medium 9. Specifically, in the recording medium 9, the labels 9A having a length of label length LL are arranged at intervals of label interval LS. In this example, with the leading edges of the label 9A (the right ends of the labels 9A in FIG. 2) when the image forming apparatus 1 pulls out the recording medium 9 from the roll and carries it in the conveying direction F1 (the right direction in FIG. 2), the label pitch LP is defined with a sum of the label length (LL) and the label interval (LS).

The image forming apparatus 1 forms an image on each of these labels 9A. In doing so, as described later, the image forming apparatus 1 predicts (or calculates), based on a detection result of a certain label 9A (or reference label LA), a position of another label 9*a* (or print target label LB) that is disposed behind the label LA by a predetermined number of labels. Thereby, an image on the label LB is formed in accordance with an accurate position of the label.

The image forming apparatus 1 (FIG. 1) includes four image forming units 10 (10Y, 10M, 10C, 10K) and four primary transfer rollers 21 (21Y, 21M, 21C, 21K) and an intermediate transfer belt 22, a driving roller 23, an idle roller 24, a tension roller 25, a backup roller 26, and a secondary transfer roller 27. These units compose the image forming unit in the image forming apparatus 1.

The four image forming units 10 form toner images. Specifically, the image forming unit 10Y forms a toner image of yellow (Y). The image forming unit 10M forms a toner image of magenta (M). The image forming unit 10C forms a cyan toner image (C). The image forming unit 10K forms a black toner image (K). The image forming units 10Y, 10M, 10C, 10K are arranged in this order in a traveling direction F2 of the intermediate transfer belt 22.

Figure 3:
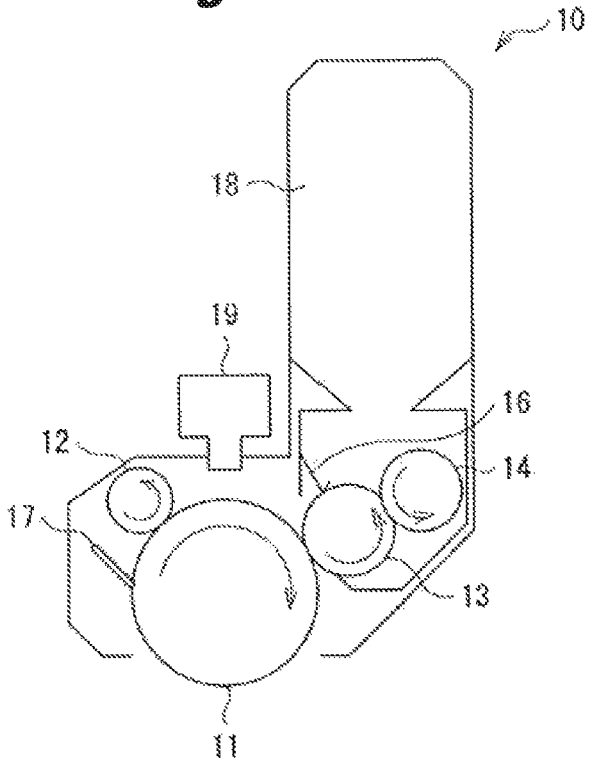
FIG. 3 is an explanatory diagram illustrating a configuration example of an image forming unit shown in FIG. 1

FIG. 3 shows a configuration example of an image forming unit 10. The image forming unit 10 includes a photosensitive body 11, a cleaning blade 17, a charge roller 12, an LED (Light Emitting Diode) head 19, a developing roller 13, a developing blade 16, a sponge roller 14, and a toner accommodating unit 18.

The photoconductor 11 carries an electrostatic latent image on the surface (surface layer portion thereof). The photosensitive body 11 rotates in a clockwise direction in this example by the power transmitted from the photosensitive body motor (not shown). The photosensitive body 11 is charged by the charge roller 12 and is exposed by the LED head 19. As a result, an electrostatic latent image is formed on the surface of the photosensitive body 11. By the toner is supplied by the developing roller 13, the toner image corresponding to the electrostatic latent image is formed (developed) on the photosensitive body 11.

The cleaning blade 17 performs a cleaning on the photosensitive body 11 by scrapping remaining toner on the surface of the photosensitive body 11. The cleaning blade 17 is also referred to as a cleaning member. The cleaning blade 17 is disposed so as to abut against the surface of the photoconductor 11 (protruding in a direction opposite to the rotating direction of the photosensitive body 11) and presses against the photosensitive body 11 with a predetermined pressing amount.

The charge roller 12 charges the surface (surface layer portion) of the photosensitive body 11. The charge roller 12 is disposed so as to be in contact with the surface (peripheral surface) of the photosensitive body 11, and arranged so as to be pressed against the photosensitive body 11 with a predetermined pressing amount. In this example, the charge roller 12 rotates counterclockwise in correspondence with the rotation of the photosensitive body 11. The charge voltage is applied from the voltage generating unit 67 (described later) to the charge roller 12.

The LED heads 19 each irradiate light to the photosensitive bodies 11. Thus, an electrostatic latent image is formed on the surface of the photoconductor 11.

The developing roller 13 carries a charged toner that has been charged to a negative voltage with its surface. The developing roller 13 is disposed so as to be in contact with the surface (peripheral surface) of the photosensitive body 11, and is disposed so as to be pressed against the photosensitive body 11 with a predetermined pressing amount. The developing roller 13 rotates counterclockwise in this example by the power transmitted from the photosensitive body motor (not shown). A developing voltage is applied to the developing roller 13 by a voltage generation unit 67 (described later).

The developing blade 16, by contact with the surface of the developing roller 13, forms a layer of toner on the surface of the developing roller 13 (toner layer). Further, the developing blade 16 regulates the thickness of the toner layer (control, adjustment). The developing blade 16 is formed, for example, by bending a plate-like elastic member made of stainless steel or the like in an L-shape. The bent portion of the developing blade 16 is disposed so as to contact the surface of the developing roller 13, and is arranged so as be pressed against the developing roller 13 at a predetermined pressing amount.

The sponge roller 14 supplies the toner stored in the toner container 18 with respect to the developing roller 13. The sponge roller 14 is disposed in contact with the surface of the developing roller 13 (peripheral surface), and is disposed so as to be pressed against the developing roller 13 at a predetermined pressing amount. In this example, the sponge roller 14 rotates counterclockwise by the power transmitted from the photosensitive body motor (not shown). As a result, in the image forming unit 10, friction occurs between the surface of the sponge roller 14 and the surface of the developing roller 13. As a result, in the image forming unit 10, the toner is charged by so-called frictional charging. A supply voltage is applied to the sponge roller 14 by a voltage generation unit 67 (described later).

The toner container 18 stores the toner. Specifically, the toner container 18 of the image forming unit 10Y stores yellow (Y) toner, the toner container 18 of the image forming unit 10M stores magenta (M) toner, the toner container 18 of the image forming unit 10C stores cyan (C) toner, and the toner container 18 of the image forming unit 10K stores black (K) toner.

With this configuration, in the image forming unit 10, the photoconductor 11 is charged by the charge roller 12, is exposed by the LED head 19. As a result, an electrostatic latent image is formed on the surface of the photosensitive body 11. In addition, the toner stored in the toner container 18 is charged by the sponge roller 14 and the developing roller 13, and is supplied to the photoconductor 11. As a result, a toner image corresponding to the electrostatic latent image is formed (developed) on the photosensitive body 11.

The four primary transfer rollers 21 each transfer the toner images formed by the four image forming units 10 electrostatically onto a transferred surface of the intermediate transfer belt 22. The primary transfer roller 21Y is disposed to face the photoconductor 11 of the image forming unit 10Y through the intermediate transfer belt 22. The primary transfer roller 21M is disposed to face the photoconductor 11 of the image forming unit 10M through the intermediate transfer belt 22. The primary transfer roller 21C is disposed to face the photoconductor 11 of the image forming unit 10C through the intermediate transfer belt 22. The primary transfer roller 21K is disposed to face the photosensitive body 11 of the image forming unit 10K through the intermediate transfer belt 22. The four primary transfer rollers 21 are arranged to be pressed against the corresponding photosensitive bodys 11 by a predetermined pressing amount. For each of the primary transfer roller 21*s*, a primary transfer voltage is applied from the voltage generating unit 67 (described later). As a result, in the image forming apparatus 1, the toner image formed by each image forming unit 10 is transferred (primary transfer) onto the transferred surface of the intermediate transfer belt 22.

The intermediate transfer belt 22 is an endless elastic belt. The intermediate transfer belt 22 is stretched (tensioned) with the driven rollers 23, the idle roller 24, tension roller 25, and the backup roller 26. Then, the intermediate transfer belt 22 circulates in the direction of the traveling direction F2 in accordance with the rotation of the driving roller 23. At that time, the intermediate transfer belt 22 passes through between the photoconductor 11 of the image forming unit 10Y and the primary transfer rollers 21Y, between the photoconductor 11 of the image forming units 10M and the primary transfer roller 21M, between the photosensitive body 11 of the image forming unit 10C and the primary transfer roller 21C, and between the photoconductor 11 of the image forming unit 10K and the primary transfer roller 21K, and between the backup roller 26 and the secondary transfer roller 27. With this configuration, the intermediate transfer belt 22 supplies the toner image transferred onto the transferred surface by the primary transfer to the secondary transfer unit 28. Here the secondary transfer unit 28 is constituted with the backup roller 26 and the secondary transfer roller 27.

The drive roller 23 circulates the intermediate transfer belt 22. In this example, the driving roller 23 is disposed upstream with respect to the four image forming units 10 in the traveling direction F2, and rotates counterclockwise in this example by the power transmitted from a belt motor (not shown). Thus, the drive roller 23 causes the circulation of the intermediate transfer belt 22 in the direction of the traveling direction F2.

The idle roller 24, in correspondence with the circulation driving of the intermediate transfer belt 22 in this example, is driven counterclockwise. The idle roller 24 is disposed downstream with respect to the four image forming units 10 in the traveling direction F2.

The tension roller 25, in correspondence with the circulation driving of the intermediate transfer belt 22 in this example, is driven clockwise. The tension roller 25 is disposed between the drive roller 23 and the backup roller 26.

The backup roller 26, in correspondence with the circulation driving of the intermediate transfer belt 22 in this example, is driven counterclockwise. The backup roller 26 is disposed so as to face the secondary transfer roller 27 sandwiching the intermediate transfer belt 22 and the conveying path 8 conveying the recording medium 9. The backup roller 26, together with the secondary transfer roller 27, constitutes the secondary transfer unit 28.

The secondary transfer roller 27 transfers the toner image on the transferred surface of the intermediate transfer belt 22 onto the transferred surface of the recording medium 9 (label side 9C). The secondary transfer roller 27 is disposed so as to face the backup roller 26 sandwiching the conveying path 8 and the intermediate transfer belt 22. The secondary transfer roller 27, together with the backup roller 26, constitutes the secondary transfer unit 28. A secondary transfer voltage is applied to the secondary transfer roller 27 by the voltage generation unit 67 (described later). As a result, in the image forming apparatus 1, the toner image on the transferred surface of the intermediate transfer belt 22 is transferred (secondarily transferred) onto the transferred surface of the recording medium 9.

Further, the image forming apparatus 1 (FIG. 1) includes a medium supply roller 31, a label sensor 32, a cutter 33, a conveying rollers 34 and 35, a label sensor 36, and a fixing device 40. These units are arranged in this order along the conveying path 8 of the recording medium 9. The recording medium 9 is guided by the medium guide 39 and is conveyed along the conveying path 8.

The medium supply rollers 31 are a pair of rollers arranged sandwiching the conveying path 8, pull the recording medium 9 from a roll around which the recording medium 9 is wound, and carry the recording medium 9 along the conveying path 8. Then, the medium supply roller 31 supplies the recording medium 9 to the label sensor 32.

The label sensor 32 detects the label 9A of the recording medium 9 fed from the medium supply roller 31. In this example, the label sensor 32 is configured using a transmissive optical sensor.

Figure 4A:
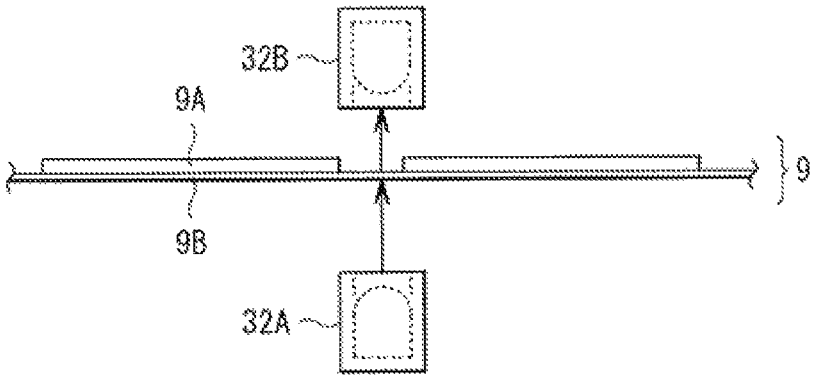
FIG. 4A is an explanatory diagram illustrating an operation example of a label sensor shown in FIG.
Figure 4B:
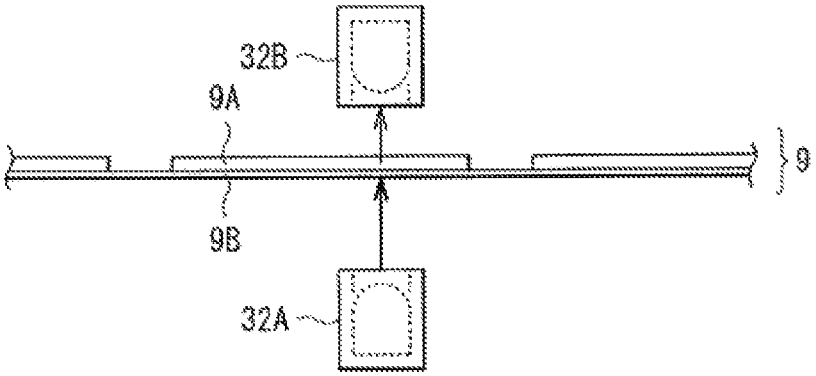
FIG. 4B is another explanatory diagram illustrating an operation example of a label sensor shown in FIG. 1.

FIGS. 4A and 4B show operation examples of the label sensor 32. The label sensor 32 has a light emitting unit 32A and a light receiving unit 32B. The light emitting unit 32A is, for example, constituted using an LED. The emitting portion 32A is arranged so as to face the light receiving unit 32B sandwiching the recording medium 9. The light receiving unit 32B is configured, for example, by using a phototransistor, and is disposed so as to face the light emitting unit 32A sandwiching the recording medium 9. In this example, the light emitting unit 32A is arranged so as to face the base sheet 9B of the recording medium 9. The light receiving unit 32B is disposed so as to face the label surface 9C of the recording medium 9.

In the label sensor 32, an optical path from the light emitting unit 32A to the light receiving unit 32B is provided so as to cross the conveying path 8 of the recording medium 9. As a result, in the label sensor 32, among the lights having the predetermined intensity emitted from the light emitting unit 32A, the light transmitted through the recording medium 9 is only received by the light receiving unit 32B. Therefore, the intensity of the light received by the light receiving unit 32B differs according to either the presence or absence of the label 9A on the optical path. For example, in the example of FIG. 4A, since there is no label 9A on the optical path, the light transmittance of the recording medium 9 becomes high, and as a result, the intensity of the light received by the light receiving unit 32B becomes strong. Further, in the example of FIG. 4B, since the label 9A is present on the optical path, the light transmittance of the recording medium 9 is lowered, and as a result, the intensity of the light received by the light receiving unit 32B is weakened.

Figure 5:
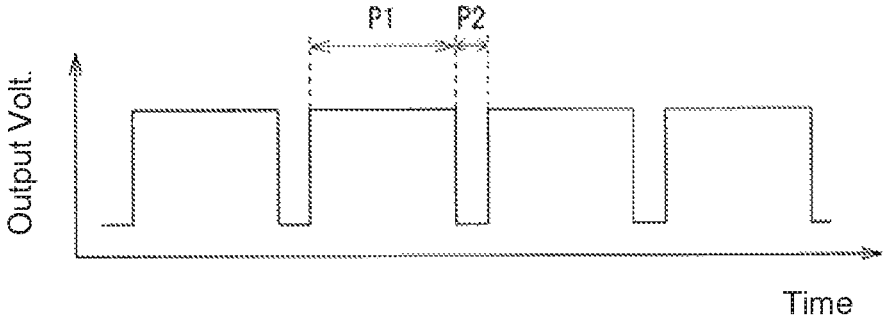
FIG. 5 is a waveform diagram showing an example of the output voltage of the label sensor shown in FIG. 1.

FIG. 5 shows an example of an output signal of the label sensor 32. When the recording medium 9 is transported by the medium supply roller 31, the label sensor 32 outputs a voltage corresponding to the presence or absence of the label 9A on the optical path. In this example, the label sensor 32 outputs a lower voltage as the intensity of the light received by the light receiving unit 32B is higher. For example, in the period P1, since the label 9A is present on the optical path (FIG. 4B), the intensity of the light received by the light receiving unit 32B decreases, and as a result, the output voltage increases. In the period P2, since the label 9A does not exist on the optical path (FIG. 4A), the intensity of the light received by the light receiving unit 32B becomes strong, and as a result, the output voltage lowers.

The image forming apparatus 1 detects the leading edge of the label 9A based on the output voltage of the label sensor 32. Then, the image forming apparatus 1 determines a cutting position of the recording medium 9 by the cutter 33 based on the detection result of the leading edge of the label 9A.

The cutter 33 (FIG. 1) is a member for cutting the recording medium 9. Specifically, the cutter 33 cuts the recording medium 9 at the cutting position that is determined by the image forming apparatus 1 based on the detection result by the label sensor 32.

The conveying roller 34 is constituted with a pair of rollers sandwiching conveying path 8, and transports the recording medium 9 in the conveying direction F1 along the conveying path 8.

The conveying roller 35, similar to the conveying roller 34, is constituted with a pair of rollers sandwiching the conveying path 8, and transports the recording medium 9 in the conveying direction F1 along the conveying path 8. Then, the conveying roller 35 supplies the recording medium 9 to the label sensor 36.

The label sensor 36 detects the label 9A of the recording medium 9 fed from the conveying roller 35. The label sensor 36, for example similar to the label sensor 32, is configured with a transmission type optical sensor. The label sensor 36 is disposed in the vicinity of the secondary transfer unit 28. The image forming apparatus 1 detects the leading edge of the label 9A based on the output voltage of the label sensor 36. Then, the image forming apparatus 1 obtains the label pitch LP based on the detection results of the leading edges of the respective labels 9A, and stores information with respect to the label pitch LP in the label pitch data 54A (described later). Further, as will be described later, the image forming apparatus 1 determines the timing (writing timing) at which the LED head 19 starts operation for forming an image on another label 9A (or print target label LB) based on the detection results of the leading edges of a certain label 9A (reference label LA). The print target label LB is arranged behind the reference label LA by a predetermined number of labels.

Thus, in the image forming apparatus 1, a timing at which the label 9A (print target label LB) reaches the secondary transfer unit 28 and another timing at which the toner image on the intermediate transfer belt 22 reaches the secondary transfer unit 28 are matched. As a result, the secondary transfer unit 28 can transfer the toner image to an appropriate position of the label 9A.

The recording medium 9 is fed to the fixing device 40 after the toner image is transferred to the secondary transfer unit 28.

The fixing unit 40 fixes the toner image transferred onto the recording medium 9 in the recording medium 9 by imparting heat and pressure to the recording medium 9. The fixing device 40 includes a fixing roller 41 and a pressure roller 42. The fixing roller 41 is, for example, is configured to include a heater 43 such as a halogen heater. The fixing roller 41 provides the heat with the toner on the recording medium 9. The pressure roller 42 is disposed such that a pressure contact portion is formed between the pressure roller 42 and the fixing roller 41, and applies pressure to the toner on the recording medium 9. As a result, in the fixing unit 40, the toner on the recording medium 9 is heated, melted, and pressurized. As a result, the toner image is fixed on the recording medium 9.

Then, the recording medium 9 on which the toner image has been fixed by the fixing unit 40 is discharged from the image forming apparatus 1, and wound with the rewinder 90 using the power supplied from a motor (not shown).

With this configuration, the image forming apparatus 1 continuously performs image forming s for all labels 9A of the recording medium 9.

Figure 6:
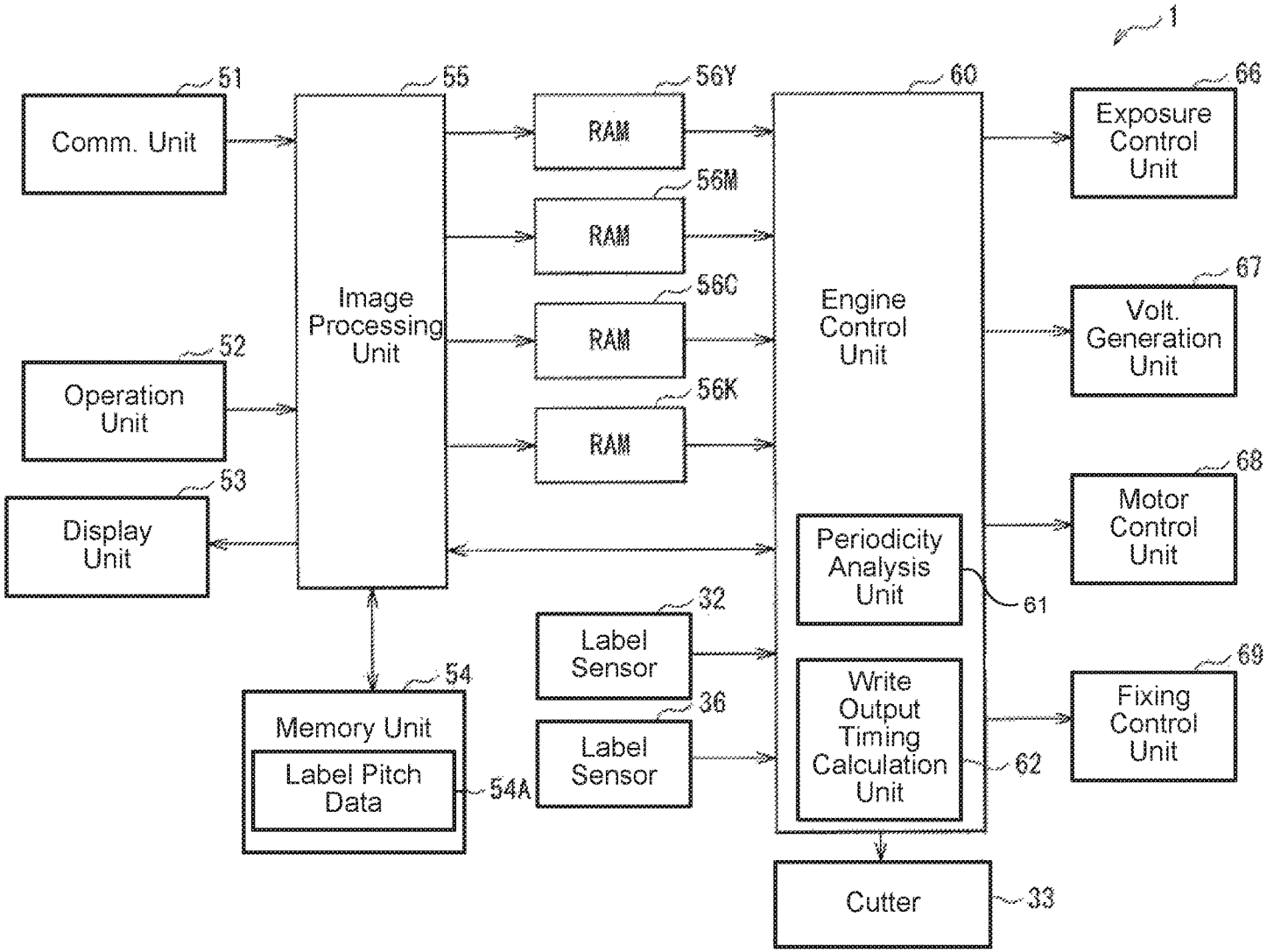
FIG. 6 is a block diagram showing an example of a control mechanism of the image forming apparatus shown in FIG. 1.

FIG. 6 shows an example of a control mechanism of the image forming apparatus 1. The image forming apparatus 1 includes a communication unit 51, an operation unit 52, a display unit 53, a memory unit 54, an image processing unit 55, four RAMS (RAM 56Y, 56M, 56C, 56K), an engine control unit 60, an exposure control unit 66, a voltage generation unit 67, a motor control unit 68, and a fixing control unit 69.

The communication unit 51 performs communication using, for example, USB (Universal Serial Bus), LAN (Local Area Network). The communication unit 51 receives, for example, print data DP including various commands and image data sent from the host computer. The operation unit 52 accepts an operation of the user. The operation unit 52 is configured, for example, by using a variety of buttons. The display unit 53 displays an operation state of the image forming apparatus 1. The display unit 53 is composed with, for example, a liquid crystal display and various indicators.

The memory unit 54 is, for example, constituted using a nonvolatile memory such as FLASH memory. The memory unit 54 stores, for example, operation programs executed by the image processing unit 55, various setting information in the image forming apparatus 1. The memory unit 54 also stores the label pitch data 54A. The label pitch data 54A, the information about the label pitch LP acquired when image formation is performed using a roll of recording medium 9 that is currently set in the image forming apparatus 1 are stored. The label pitch data 54 A is reset when the roll of the recording medium 9 is exchanged.

The image processing unit 55 performs image processing based on the print data DP received from the communication unit 51. The print data DP includes image data and various commands. The image processing unit 55 performs processings based on various commands included in the print data DP and various information stored in the memory unit 54 and gives instructions to the engine control unit 60. Further, the image processing unit 55 analyzes the image data included in the print data DP, and performs expansion processing to bitmap data. The image processing unit 55, among the bit map data, supplies bit map data to be processed by the image forming units 10Y to RAM56Y, supplies bitmap data to be processed by the image forming units 10M to RAM56M, supplies bit map data to be processed by the image forming unit 10C to the RAM 56C, and supplies bit map data to be processed by the image forming unit 10K to the RAM 56K. The image processing unit 55 is configured, for example, using a microprocessor, RAM, or the like, and operates based on the operation programs stored in the memory unit 54.

The four RAM56 stores the bit map data. Specifically, RAM56Y stores bitmap data to be processed by the image forming unit 10Y of the bit map data. RAM56M stores bitmap data to be processed by the image forming units 10M. RAM56C stores bitmap data to be processed by the image forming units 10C. RAM56K stores bitmap data to be processed by the image forming unit 10K.

The engine control unit 60, based on an instruction from the image processing unit 55, controls the image forming operation in the image forming apparatus 1. Specifically, the engine control unit 60, for example, supplies the data stored in four RAM56 to the exposure control unit 66. Further, the engine control unit 60 instructs the exposure control unit 66 so that the exposure control unit 66 controls the operation of the LED head 19 of the four image forming units 10. Further, the engine control unit 60 provides instructions to the voltage generation unit 67 so that, for example, the voltage generation unit 67 generates various voltages required to the image formation (charge voltage, developing voltage, supply voltage, primary transfer voltage, secondary transfer voltage, etc.), which are required for the image forming. The engine control unit 60 provides instructions to motor control unit 68 so that, for example, the motor control unit 68 controls the various motors of the image forming apparatus 1 (photosensitive body motor, belt motor or the like). The engine control unit 60 is, for example, as the fixing control unit 69 provides instructions to the fixing control unit 69 so that, for example, the fixing control unit 69 controls the operations of the fixing device 40 by causing the heater 43 to operate.

The engine control unit 60, for example based on the output voltage of the label sensor 32, detects the leading edge of each label 9A. Further, the engine control unit 60 performs a cutting instruction of the recording medium 9 with respect to the cutter 33 on the basis of the detection result. The engine control unit 60, for example based on the output voltage of the label sensor 36, detects the leading edge of each label 9A, obtains the label pitch LP on the basis of the detection result. Then, the engine control unit 60 supplies information about the label pitch LP to the memory 54 through the image processing unit 55 and has a function of storing the label pitch data 54A The engine control unit 60 includes a periodicity analysis unit 61 and a write output timing calculation unit 62.

The periodicity analysis unit 61, based on the stored label pitch data 54A in the memory unit 54, analyzes the periodicity of the label pitch LP.

Figure 7:
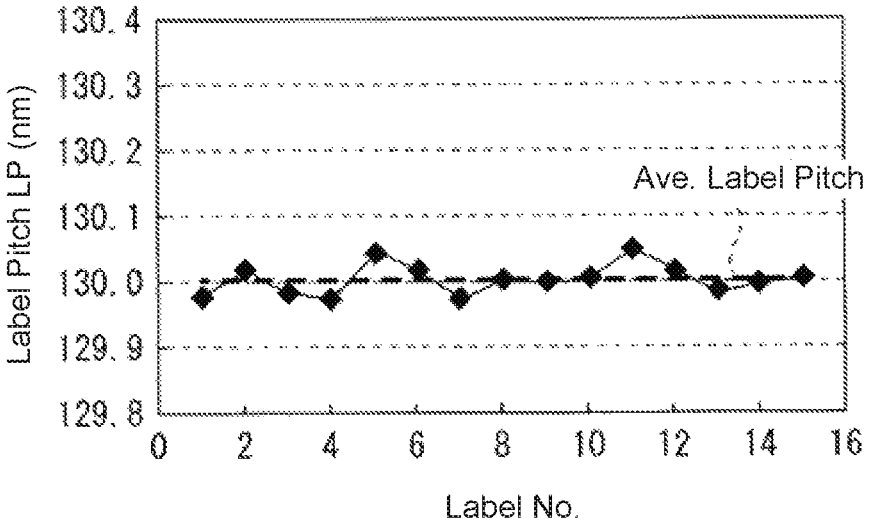
FIG. 7 is a characteristic diagram showing an example of characteristics of the label pitch of the recording medium.

FIG. 7 shows the label pitch LP in a certain recording medium 91. The recording medium 91 is produced by a so-called rotary type method. Specifically, for example, by rolling a cylindrical mold on which a blade having shape in correspondence with contours of one or more labels 9A's shape is disposed on the peripheral surface on a recording medium in which the label 9A has not yet been formed, a series of labels 9A is formed. In the example of FIG. 7, the label pitch LP is deviated in a range between −0.04 mm~+0.04 mm with respect to the average label pitch, the variations in label pitch LP is relatively small. In this example, an apparent periodicity of the label pitch LP does not occur.

Figure 8:
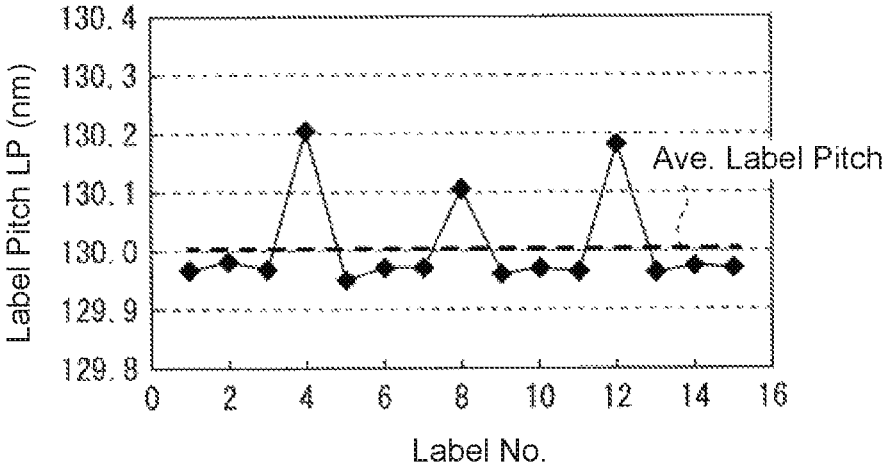
FIG. 8 is a characteristic diagram showing an example of characteristics of the label pitch of another recording medium.
Figure 9:
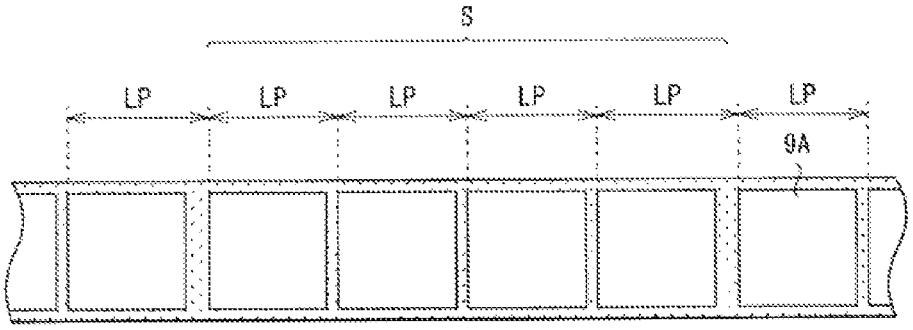
FIG. 9 is an explanatory view showing an arrangement example of the label in the recording medium shown in FIG. 8.

FIG. 8 shows the label pitch LP in other recording medium 92. FIG. 9 shows an example of the arrangement of the label 9A in the recording medium 92. Incidentally, for convenience of explanation, FIG. 9 is exaggerated. The recording medium 91 is produced by the so-called flat pressure method. Specifically, in this example, a plate-like mold on which a blade having a shape corresponding to the contour shape of four labels 9A is disposed on the surface are successively pressed onto a recording medium in which the label 9A has not yet been formed. By doing that, a plurality of labels 9A in which four labels 9A are grouped as one set is formed. In the example of FIG. 8, the label pitch LP is deviated in a range between −0.05 mm~+0.2 mm at a maximum for the average label pitch. In particular, in this example, as shown in FIGS. 8 and 9, at a rate of once every four labels 9A, a label pitch LP increases. That is, in this example, because four labels 9A are produced as one set (label set S), small variations of the label pitch LP are found in the label set S. Also, a label pitch LP between label sets S has greater variation than a label pitch variation in the label set S. Thus, in the recording medium 92, there is a periodicity of four labels 9A units. That is, the label number in each unit (or unit label number PP) is 4 (PP=4).

Thus, the recording medium 9, for example, often has the periodicity of label pitch LP depending on the production method. The periodicity analysis unit 61, based on the stored label pitch data 54A in the memory unit 54, obtains the information about the periodicity of the label pitch LP. The periodicity analysis unit 61, as described later, obtains information about the periodicity of the label pitch LP by using an autocorrelation function.

The write output timing calculation unit 62, as described later, based on the analysis result of the periodicity analysis unit 61, calculates the timing at which a toner image is transferred to an appropriate position of the label 9A in the secondary transfer unit 28.

The exposure control unit 66, based on an instruction from the engine control unit 60, controls the operation of the LED head 19 of the four image forming units 10. Specifically, the exposure control unit 66 controls the operation of the LED head 19 of the image forming units 10Y on the basis of the data read out from RAM56Y. The exposure control unit 66 controls the operation of the LED head 19 of the image forming units 10M on the basis of the data read out from RAM56M. It controls the operation of the LED head 19 of the image forming unit 10C based on the read data from RAM56C, and the operation of the LED head 19 of the image forming unit 10K on the basis of the data read from RAM56K. At that time, the exposure control unit 66, at the timing calculated by the write output timing calculation unit 62, starts the operations of the LED heads 19 of the four image forming units 10 respectively.

The voltage generation unit 67, based on an instruction from the engine control unit 60, generates various voltages needed for image forming (charge voltage, developing voltage, the supply voltage, the primary transfer voltage, the secondary transfer voltage, etc.).

The motor control unit 68, based on an instruction from the engine control unit 60, controls the operations of the various motors of the image forming apparatus 1 (photosensitive body motor, belt motor or the like).

The fixing control unit 69, based on an instruction from the engine control unit 60, operates the heater 43 of the fixing unit 40, and controls the operation of the fixing device 40.

Here, the medium supply roller 31, the conveying rollers 34 and 35 correspond to an example of a "conveyance unit" in the present invention. The label sensor 36 corresponds to an example of a "sensor" in the present invention. The four image forming units 10, the four primary transfer rollers 21, the intermediate transfer belt 22, the drive roller 23, the idle roller 24, the tension roller 25, and the secondary transfer unit 28 correspond to one example of the "image forming unit" of the present invention. The engine control unit 60 corresponds to an example of the "control unit" in the present invention.

[Operations and Actions]

Next, the operations and actions of the image forming apparatus 1 of this embodiment are explained.

(Overall Operation Overview)

With reference to FIGS. 1 and 6, the overall outline of operation of the image forming apparatus 1 is explained. In the image forming apparatus 1 (FIG. 1), the medium supply roller 31 pulls the recording medium 9 out from a roll around which the recording medium 9 is wound, conveying the recording medium 9 along the conveying path 8. The conveying rollers 34 and 35 convey the recording medium 9 along the conveying path 8. The label sensor 36 detects the label 9A of the recording medium 9 fed from the conveying roller 35. The engine control unit 60, based on the output voltage of the label sensor 36, detects the leading edge of the label 9A. Then, the engine control unit 60 obtains the label pitch LP on the basis of the detection result of the leading edge of each label 9A, accumulates information about the label pitch LP in the label pitch data 54A. The engine control unit 60, as described later, based on the detection results of the leading edges of one label 9A (reference label LA), determines a timing (write output timing) of the LED head 19 to start to operate, at the timing for forming an image on a label 9A (or print target label LB) which is located behind a predetermined number of labels than the label 9A.

The exposure control unit 66, at a timing corresponding to the write output timing that the engine control unit 60 has determined, start the operation of the LED head 19 of the four image forming units 10 respectively. Thus, the four image forming units 10 form a toner image. The four primary transfer rollers 21 respectively transfer the toner image onto a transfer surface of the intermediate transfer belt 22 of the photosensitive body 11 of the corresponding image forming unit 10 (primary transfer). The toner image of the intermediate transfer belt 22 reaches the secondary transfer unit 28 by the intermediate transfer belt circulating. The secondary transfer unit 28 transfers the toner image on the transferred surface of the intermediate transfer belt 22 onto the transferred surface of the recording medium 9 (or label side 9C) (secondary transfer). Fuser 40 fixes the toner image on the recording medium 9. The recording medium 9 on which the toner image has been fixed by the fixing unit 40 is discharged from the image forming apparatus 1, being wound by the rewinder 90.

(Detailed Operation)

Next, detailed operation of the image forming apparatus 1 is described.

When the communication unit 51 (FIG. 6) receives print data DP, first, the image processing unit 55 analyzes the image data included in the print data DP, performs expansion processing to the bitmap data. RAM56Y stores the bitmap data to be processed by the image forming unit 10Y among the bitmap data. RAM56M stores the bitmap data to be processed by the image forming units 10M. RAM56C stores the bitmap data to be processed by the image forming unit 10C. RAM56K stores bitmap data to be processed by the image forming unit 10K. The image processing unit 55 performs this expansion process, in parallel, instructs the engine control unit 60 to start the image forming operation.

The engine control unit 60 performs an instruction to the fixing control unit 69, the fixing control unit 69 controls operations of the fixing device 40 and heater 43 so that the temperature of the fixing device 40 reaches the fixable temperature at which a toner image is fixed. When warming up of the fixing device 40 is completed, the engine control unit 60 performs an instruction to the motor control unit 68, the instructed motor control unit 68 operates the driving roller 23, four image forming units 10, the medium supply roller 31, two conveying rollers 34 and 35, the fixing roller 41, and the rewinder 90. At this time, the speed for conveying the recording medium 9 in the conveying direction F1 is substantially the same as the speed of the intermediate transfer belt 22 travels in the traveling direction F2. The engine control unit 60 performs an instruction to the voltage generation unit 67, the voltage generating unit 67 generates various voltages required for image forming (charge voltage, developing voltage, supply voltage, primary transfer voltage, secondary transfer voltage or the like).

In the image forming unit 10 (FIG. 3), the charging voltage of, for example, "−1000 V" is applied to the charge roller 12. Thus, the surface of the photosensitive body 11 is charged, the surface voltage, for example, becomes "−600 V". Further, the developing roller 13, for example, is applied by "−200 V" developing voltage, and the sponge roller 14, for example, is applied by "−250V" supply voltage. The toner supplied from the toner container 18 is negatively charged by the friction between the surfaces of the developing roller 13 and the sponge roller 14. The toner charged in this way, based on the voltage difference between the voltages of the sponge roller 14 and the developing roller 13, adheres to the developing roller 13. The toner adhering to the developing roller 13 is regulated by the developing blade 16 so as to have a predetermined thickness. The toner of the developing roller 13 is supplied to the nip portion between the developing roller 13 and the photosensitive body 11 by the developing roller 13 rotating.

The engine control unit 60 (FIG. 6) performs an instruction to the exposure control unit 66, the exposure control unit 66 controls the operation of the LED head 19 of the four image forming units 10. Specifically, the exposure control unit 66, based on the bit map data read out from RAM56Y, drives the LED heads 19 of the image forming unit 10Y in one line unit. Based on the bitmap data read from RAM56M, the engine control unit 60 drives the LED heads 19 of the image forming unit 10M in one line unit. Based on the bitmap data read from RAM56C, the engine control unit 60 drives the LED heads 19 of the image forming unit 10C in one line unit. Based on the bitmap data read from RAM56K, the engine control unit 60 drives the LED heads 19 of the image forming units 10K in one line unit. At that time, the drive timing of the LED head 19 of the four image forming units 10 (write output timing) is set by shifting according to the arrangement of the four image forming units 10. Each of LED heads 19 turns off or on the LED light in response to the supplied bit map data. Then, these LED heads 19 expose the photosensitive body 11 that has been charged to "−600 V". Exposed portions of the surface of the photosensitive body 11 are discharged, becoming a voltage, for example. "−50 V". In this way, an electrostatic latent image is formed in the photosensitive body 11.

When more specifically noted, the LED heads are driven by every one line unit as synchronizing with a period for rotation distance. The period of rotation distance is equal to time during which a surface of charged photosensitive body 11 by the charge roller moves one line distance (e.g. 1/1200 inches in a case where an image forming is performed by 1200 dot per inch).

The electrostatic latent image formed on the photosensitive body 11 reaches the nip portion between the developing roller 13 and the photosensitive body 11 by the photosensitive body 11 rotating. Voltage of the developing roller 13, for example, is "−200 V" Then, since the toner was negatively charged is attached to the developing roller 13, based on the voltage difference between the voltage of the developing roller 13 and the voltage of electrostatic latent image of the photosensitive body 11, the toner is selectively attached to the photosensitive body 11. As a result, a toner image corresponding to the electrostatic latent image is formed (developed) on the photosensitive body 11.

The toner image formed on the photosensitive body 11, by the photosensitive body 11 rotating, reaches the nip portion between the photoconductor 11 and the primary transfer roller 21. Then, the toner image of yellow formed on the photosensitive body 11 of the image forming unit 10Y is transferred onto the transferred surface of the intermediate transfer belt 22, the toner image of magenta formed on the photosensitive body 11 of the image forming unit 10M is transferred onto the transferred surface of the intermediate transfer belt 22, the toner image of cyan formed on the photosensitive body 11 of the image forming unit 10C is transferred onto the transferred surface of the intermediate transfer belt 22, the toner image of black formed on the photosensitive body 11 of the image forming unit 10K is transferred onto the transferred surface of the intermediate transfer belt 22. As a result, on the transfer surface of the intermediate transfer belt 22, the yellow toner image, magenta toner image, cyan toner image, and black toner images are laminated in this order. That is, as described above, the driving timings of the LED heads 19 of the four image forming units 10 are individually set in accordance with the arrangement of the four image forming units 10. Thereby, the positions of the toner images on the transferred surface of the intermediate transfer belt 22 coincide.

The toner image on the intermediate transfer belt 22 reaches the secondary transfer unit 28 by the intermediate transfer belt 22 circulating. The secondary transfer unit 28 transfers the toner image on the transfer surface of the intermediate transfer belt 22 onto the transferred surface of the recording medium 9 (label side 9C) (secondary transfer).

The engine control unit 60, as described later, based on the detection result of the leading edge of a label 9A (reference label LA), determines the timing (write out timing) of the LED head 19 starting to operate to form an image on the print target label LB. The print target label LB means a label that is positioned behind the reference label LA by a predetermined number of labels. At that time, when there is periodicity in the label pitch LP of the recording medium 9, the engine control unit 60 determines the write output timing in consideration of the periodicity. Thus, in the image forming apparatus 1, the timing at which the label 9A in the recording medium 9 reaches the secondary transfer unit 28 matches the timing at which the toner image on the intermediate transfer belt 22 reaches the secondary transfer unit 28. Next, the write output timing will be described in detail.

(Write Output Timing

As described above, when the warming up of the fixing device 40 is completed, the medium supply roller 31 and the conveying rollers 34 and 35 start conveying the recording medium 9. Then, the conveying speed of the recording medium 9 has reached the target speed, and when the conveying speed becomes stable, the label sensor 36 starts detecting the respective label 9A of the recording medium 9. For example, the first label 9A that is detected by the label sensor 36 first is reference label LA. Then, after the label sensor 36 detects the leading edge of the reference label LA, LED head 19 of the four image forming units 10 are driven, the toner image is formed on another label (print target label LB) disposed behind the reference label LA). This is secondarily transferred. As this manner, the label on which the secondarily transferring occurs may be the "N" th label 9A, the timing of the LED head 19 for starting the formation of an image on the "N" th label 9A (write output timing) will be described. When the print target label LB is 3rd label, the leading edge of the 3rd label is positioned twice as large as the label pitch LP behind the leading edge of the first label (or reference label LA). When the print target label LB is 5th label, the leading edge of the 5th label is positioned four times as large as the label pitch LP behind the leading edge of the first label (or reference label LA).

Figure 10:
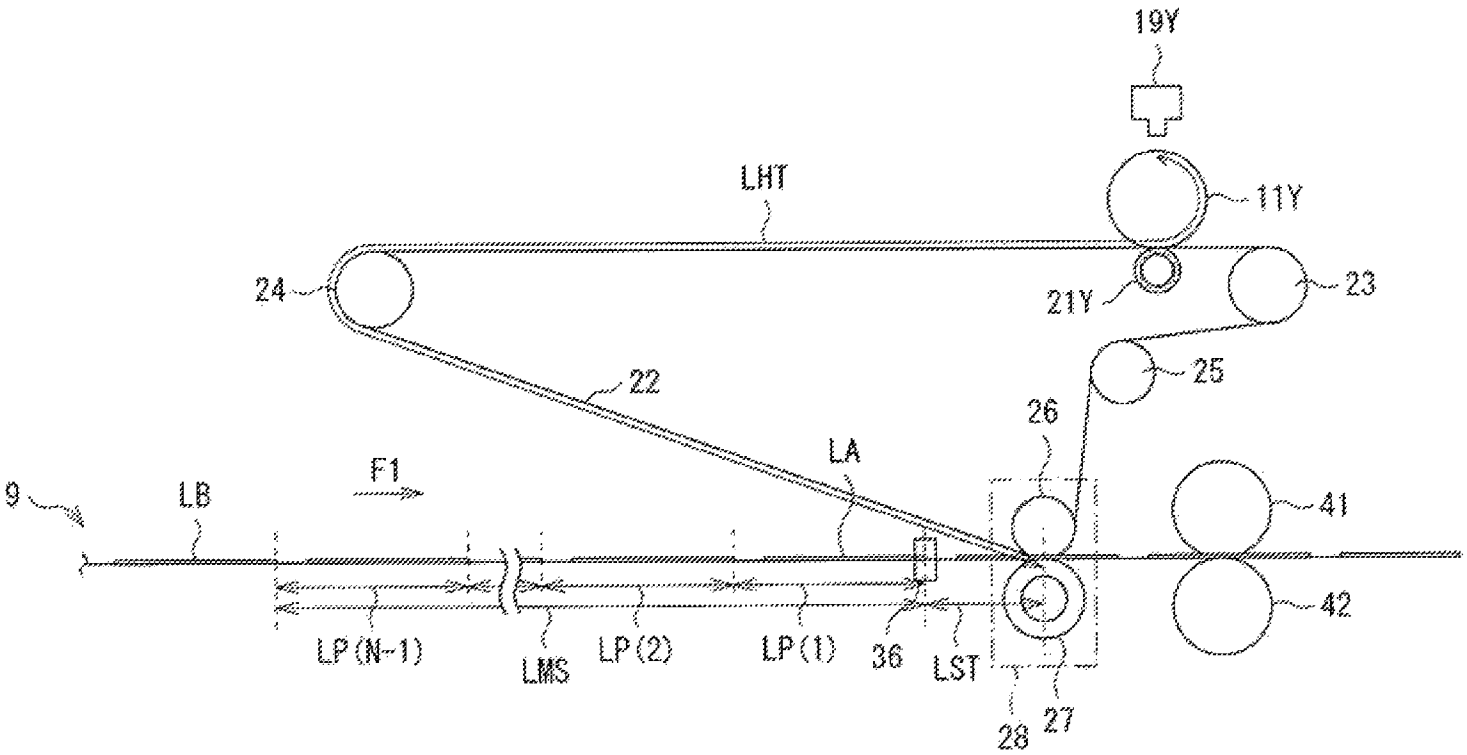
FIG. 10 is an explanatory view for explaining a write output timing of the image forming apparatus shown in FIG. 1.

FIG. 10 shows the operations of the LED head 19 that were performed from the LED head 19 is driven, the exposure operation starts, until the secondary transfer in the secondary transfer unit 28 is completed. In FIG. 10, as indicated with the references, the LED head and the photosensitive body are the LED head 19Y and the photosensitive body 11Y of the image forming unit 10Y. Further, in FIG. 10, several members are omitted to be shown.

In order to transfer the toner image to an appropriate position of the Nth label 9A (print target label LB), it is important to adjust a write output timing for the LED head 19 arranged in the most upstream in the traveling direction F2. In the embodiment, the LED head is LED head 19Y of the image forming unit 10Y. Herein, a distance of a path along which a toner image is conveyed is denoted with LHT, the distance being determined from a surface position where to be exposed by the LED head 19Y in the photosensitive body 11Y to the nip portion of the secondary transfer portion 28. Further, a distance from the label sensor 36 to the nip portion of the secondary transfer unit 28 is denoted with LST. The average value of the label pitches LP of the recording medium 9 (average label pitch) is denoted with LPa. In this case, "N" is expressed by the following equation.

[Equation 1]

$$N = \text{Roundup}\left(\frac{LHT - LST}{LPa}\right) \quad (1)$$

where, Roundup function is a function for rounding up a decimal point.

As shown in FIG. 10, at the timing of detecting the leading edge of the first label 9A (reference label LA), a distance LMS between the label sensor 36 and the leading edge of the Nth label 9A (or print target label LB) is expressed by the following equation.

[Equation 2]

$$LMS=(N-1)\times LPa \quad (2)$$

Therefore, a distance LF for the recording medium 9 to be conveyed is expressed by the following equation. The distance is determined from a timing when the leading edge of first label 9A (reference label LA) is detected by the label sensor 36 up to a timing when the LED head 19Y starts an exposure operation, it can be expressed by the following equation.

[Equation 3]

$$LF=LMS-(LHT-LST) \quad (3)$$

By substituting Equation (2) into the equation (3), the following equation is obtained.

[Equation 4]

$$LF=(N-1)\times LPa-(LHT-LST) \quad (4)$$

That is, since a timing, which is from when the label sensor 36 detects the leading edge of the first label 9A (reference label LA) to the recording medium 9 is conveyed by distance LF, is used for the write output timing for the LED head 19Y, it is possible to match the timing of the Nth label 9A (print target label LB) reaching the secondary transfer unit 28 and the timing at which the toner image reaches the secondary transfer unit 28.

Write output timing calculation unit 62, for example, obtains the distance LF using Equation (4), and obtains a timing at which the recording medium 9 is conveyed by only distance LF as a write output timing. The engine control unit 60 controls to causes the LED head 19Y to start an exposure operation. Thus, in the image forming apparatus 1, by utilizing the detection result of the leading edge of the label 9A by label sensor 36, it is realized to transfer the toner image to an appropriate position of the Nth label 9A (print target label LB).

In this example, based on the leading edge of the detection result of the first label 9A (reference label LA), the write output timing for forming an image on the Nth label 9A (print target label LB) is determined. The same method is applied to the other label 9A. Specifically, based on the detection result of the leading edge of the second piece of labels 9A (reference label LA), another write output timing for forming an image on the (N+1)th labels 9A (print target label LB) is determined. Based on the detection result of the leading edge of the third piece of the label 9A (reference label LA), the write output timing for forming an image on the (N+2)th label 9A (print target label LB) is determined. That is, based on the detection result of the leading edge of the (F)th label 9A (reference label LA), a write output timing for forming an image on (F+N−1)th labels 9A (print target label LB) is determined. In this manner, the image forming apparatus 1 determines write output timings for a plurality of labels 9A of the recording medium 9, and sequentially forms images thereon.

As described above, the label pitch LP of the recording medium 9 may for example vary due to the manufacturing method of the recording medium 9. For example, if there is a periodicity in the label pitch LP of the recording medium 9 as shown in FIGS. 8 and 9, when obtaining the distance LF using Equation (4) and determining the write output timing on the basis of the distance LF, there is a possibility that a position where an image is formed is shifted. That is, in Equation (4), the distance LMS that is determined using the average label pitch LPa is used. Therefore, when there is a deviation (or gap) between a value obtained by multiplying the average label pitch LPa (N−1) times and a sum of the actual label pitch LP, the position where the image is formed is shifted by the deviation. The deviation amount DL is expressed by the following equation.

[Equation 5]

$$DL = (N-1)\times LPa - \sum_{n=1}^{N-1} LP(n) \quad (5)$$

where, LP (1), LP (2), ~, LP (N−1) mean, as shown in FIG. 10, the label pitches LP of labels 9A.

For example, in the case of using the recording medium 91 shown in FIG. 7, the label 9A having a label number "1" is the first piece of label, and the 6th label and "N=6", and the average label pitch is 130.0 [mm], the deviation amount DL is 0.008 [mm]. On the other hand, for example, in the case of using a recording medium 92 shown in FIGS. 8 and 9, and the same conditions above, the deviation amount DL is −0.074 [mm]. In this example, the deviation amount DL in the case of using the recording medium 92 is about 10 times larger than the deviation amount DL in the case of using the recording medium 91. Thus, in the case of using the recording medium 9 having a periodicity of the label pitch LP, when determining the write output timing using Equation (4), the position where an image is formed may be largely shifted.

Therefore, in the image forming apparatus 1, information about the label pitch LP is accumulated in the label pitch data 54A, the periodicity analysis unit 61, based on the label pitch data 54A, analyzes the periodicity of the label pitch LP. The periodicity analysis unit 61 determines that there is "no periodicity" if clear periodicity of the label pitch LP is not found/When the periodicity is found on the label pitch LP, the unit determines "periodicity present" as well as determining a unit label number PP with respect to the periodicity.

Then, the write output timing calculation unit 62 obtains an average label pitch LPa based on the label pitch data 54A if there is no periodicity in the label pitch LP, further obtains the distance LF using the average label pitch LPa and Equation (4), and obtains the write output timing based on the distance LF.

On the other hand, the write output timing calculation unit 62 obtains, if there is a periodicity in the label pitch LP, the write output timing using the period PP as follows.

Figure 11:
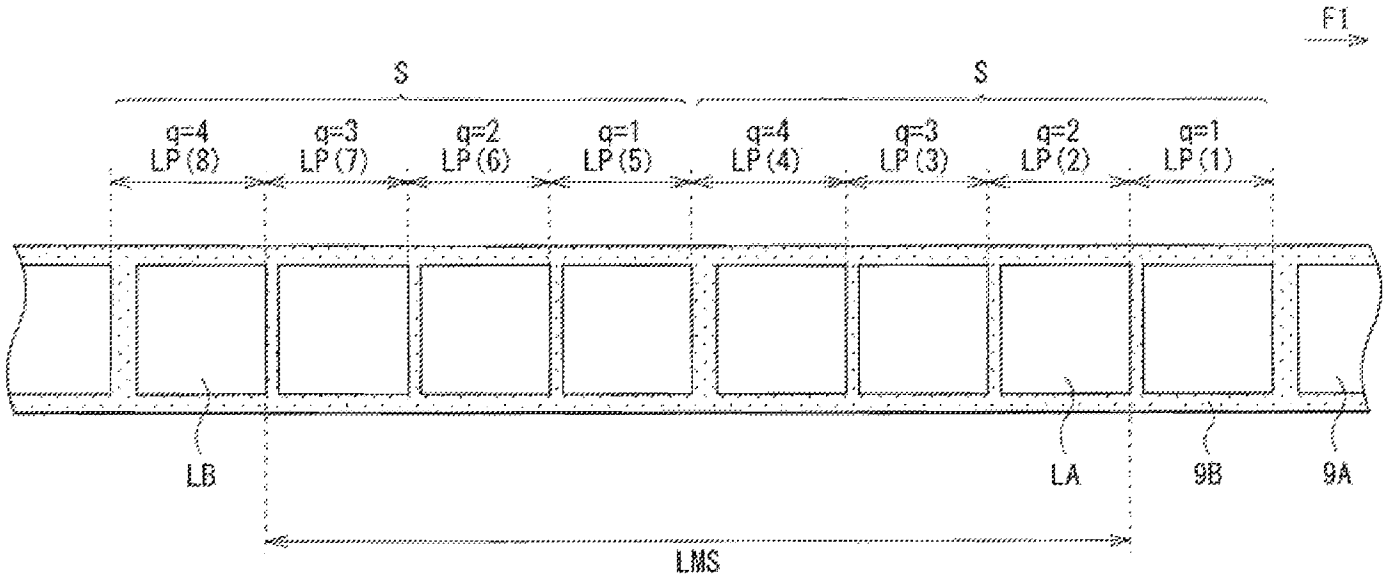
FIG. 11 is an explanatory diagram for explaining the write output timing.

FIG. 11 shows an example of a recording medium 92 having periodicity in the label pitch LP. In this example, the label pitch LP increases at a rate of once every four labels 9A. It is assumed that, in the label pitch data 54A, such label pitch LP for Y time circles is accumulated. The periodicity analysis unit 61 determines, based on the label pitch data 54A, "periodicity present (Yes)" and obtains the unit label number PP (PP=4 in this example).

The write output timing calculation unit 62 acknowledges, based on the unit label number PP obtained by the periodicity analysis unit 61, a label group of the labels 9A of which the number is the same as that of the unit label number PP (label set S in this example). Then, the write output timing calculation unit 62 obtains, using the following equation, an average label pitch LPa (q) for the label 9A that is at the same position q in each label set S.

[Equation 6]

$$LPa(q) = \sum_{y=0}^{Y} \frac{LP(q + PP \times y)}{Y} \tag{6}$$

In this example, these average label pitches below are expressed with the following equations:

LPa (1) is an average label pitch of the label 9A arranged at the arrangement position of q=1:

LPa (2) is an average label pitch of the label 9A arranged at the arrangement position of q=2:

LPa (3) is an average label pitch of the label 9A arranged at the arrangement position of q=3:

LPa (4) is an average label pitch of the label 9A arranged at the arrangement position of q=4

[Equation 7]

$$\left.\begin{aligned} LPa(1) &= \frac{LP(1) + LP(5) + LP(9) + \ldots + LP(1 + 4Y)}{Y} \\ LPa(2) &= \frac{LP(2) + LP(6) + LP(10) + \ldots + LP(2 + 4Y)}{Y} \\ LPa(3) &= \frac{LP(3) + LP(7) + LP(11) + \ldots + LP(3 + 4Y)}{Y} \\ LPa(4) &= \frac{LP(4) + LP(8) + LP(12) + \ldots + LP(4 + 4Y)}{Y} \end{aligned}\right\} \tag{7}$$

Then, the write output timing calculation unit 62 obtains that the label 9A (reference label LA) detected by the label sensor 36 is positioned at any one of position q. By using the position q of the reference label LA and the average label pitch LPa at each of positions q (q), the distance LMS is determined.

Specifically, for example, when the reference label LA is a label 9A arranged at the arrangement position of q=2 and where N is 7 (N=7), the print target label LB is, as shown in FIG. 11, label 9A arranged at the arrangement position of q=4. Therefore, the distance LMS between the label sensor 36 and the leading edge of the print target label LB at the timing when the label sensor 36 detects the leading edge of the reference label LA is expressed by the following equation.

[Equation 8]

$$LMS = LPa(1) + 2 \times LPa(2) + 2 \times LPa(3) + LPa(4) \tag{8}$$

Thus, the write output timing calculation unit 62 obtains the distance LMS in that manner, obtains the distance LF using the calculated distance LMS and Equation (3), and obtains the write output timing on the basis of the distance LF.

Thus, when there is no periodicity in the label pitch LP, the image forming apparatus 1 calculates the write output timing by using the average label pitch LPa. On the other hand, when there is a periodicity in the label pitch LP, the image forming apparatus 1 calculates the write output timing by using the average label pitch LPa(q) at each of positions q. Thus, regardless of the periodicity of the label pitch LP, the image forming apparatus 1 form an image at a proper position of the label 9A.

Next, operations of the periodicity analysis unit 61 and the write output timing calculation unit 62 are described in detail.

(Operation of Periodicity Analysis Unit 61)

The periodicity analysis unit 61 analyzes, based on the label pitch data 54A, the periodicity of the label pitch LP using an autocorrelation function. Hereinafter, operations of the image forming apparatus 1 including the operation of the periodicity analysis unit 61 are described in detail.

Figure 12:
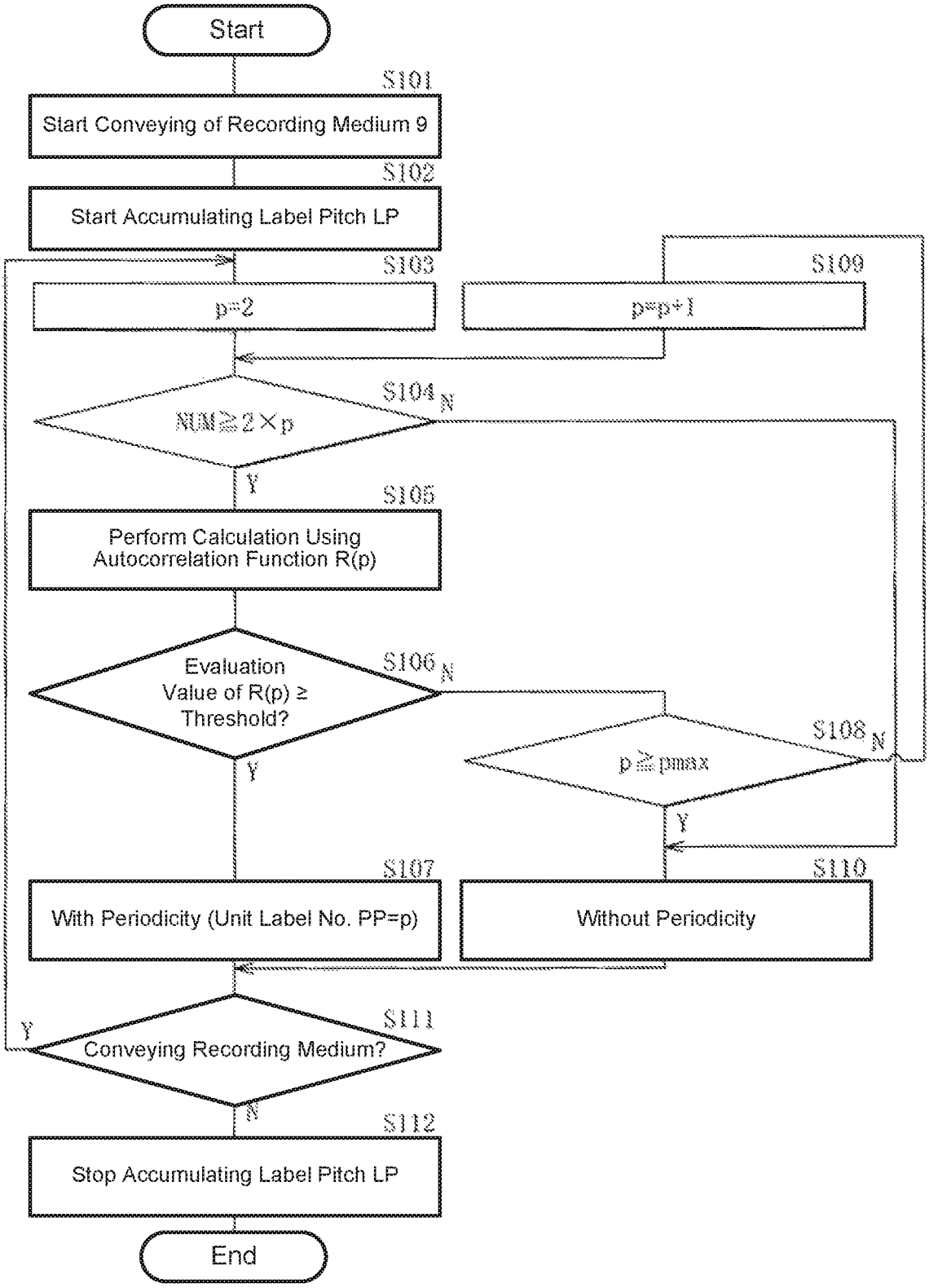
FIG. 12 is a flowchart illustrating an operation example of the image forming apparatus shown in FIG. 1

FIG. 12 shows an example of an operation for analyzing the periodicity of the label pitch LP in the image forming apparatus 1. The periodicity analysis unit 61 analyzes, based on the label pitch data 54A, the periodicity using the autocorrelation function R(p) and by sequentially set the parameter p in the range from "2" to "p max" (e.g. "10"). Then, if the evaluation value of the autocorrelation function R (p) is above a predetermined threshold value, the periodicity analysis unit 61 determines that there is a periodicity of the label pitch LP, the periodicity having a unit label number PP that is a number indicated by the parameter p at that time. Hereinafter, the operation is described in detail.

When the print data DP is supplied, and the image forming apparatus 1 starts conveying the recording medium 9 (step S101), the image forming apparatus 1 starts accumulating the label pitch LP (step S102). Specifically, the engine control unit 60 detects, based on the output voltage of the label sensor 36, the leading edge of each label 9A, obtains the label pitch LP on the basis of the detection result. Then, the engine control unit 60 supplies the information about the label pitch LP to the memory 54 via the image processing unit 55, and stores the label pitch data 54A. Thereafter, the image forming apparatus 1 continues to accumulate the label pitch LP.

Next, the periodicity analysis unit 61 sets the parameter p "2" (p=2) (step S103).

Next, the periodicity analysis unit 61 confirms whether or not the data number NUM that is the number of data about the label pitch LP contained in the label pitch data 54A is twice as large as the parameters p (NUM≥2×p) (step S104). That is, the periodicity analysis unit 61 confirms whether or not there is enough number of data required for analysis. If the data number NUM is less than twice the parameter p ("N" in step S104), the periodicity analysis unit 61 determines that the data on the label pitch data 54A is not enough. In this example, the periodicity analysis unit 61 determines that there is no periodicity in the label pitch LP (step S110), it proceeds to step S111.

In step S104, if the data number NUM is more than twice as large as the parameter p ("Y" in step S104), the periodicity analysis unit 61 determines that there is enough number of data in the label pitch data 54A, which is required for analyzing, performs the calculation using the autocorrelation function R (p) based on the label pitch data 54A (step S105).

Next, the periodicity analysis unit 61 confirms whether or not the evaluation value of the autocorrelation function R (p) is greater than a predetermined threshold value (step S106). If the evaluation value of the autocorrelation function R (p) is equal to or greater than the predetermined threshold value ("Y" in step S106), the periodicity analysis unit 61 determines that there is a periodicity of the label pitch LP, the periodicity having the unit label number PP that is the number indicated by the parameter p (step S107). In the step, it is shown "with periodicity." Then, it proceeds to step S111.

Further, in step S106, in a case where the evaluation value of the autocorrelation function R (p) is less than the predetermined threshold value ("N" in step S106), it is confirmed whether or not the parameter p is value pmax or more (step S108). If the parameter p is less than the value pmax ("N" in step S108), incrementing the parameter p (step S109), it proceeds to step S104. Further, if the parameter p is the value pmax or more ("Y" in step S108), the periodicity analysis unit 61 determines that there is no periodicity of the label pitch LP because any evaluation value of the autocorrelation function R (p) in any parameter p is lower than a predetermined threshold value (step S110). Then, it proceeds to step S111.

Next, the engine control unit 60 checks whether or not the image forming apparatus 1 is still conveying the recording medium 9 (step S111). In the case where the image forming apparatus 1 is still conveying the recording medium 9 ("Y" in step S111), it returns to step S103, and repeats the flow. Thus, the periodicity analysis unit 61 uses the latest label pitch data 54A, and analyzes the periodicity of the label pitch LP again.

In step S111, in the case where the image forming apparatus 1 stops the conveyance of the recording medium 9 ("N" in step S111), the image forming apparatus 1 stops the accumulation of the label pitch LP (step S112).

In the above, this flow ends.

In this way, the periodicity analysis unit 61, based on the label pitch data 54A, using an autocorrelation function R (p), analyzes the periodicity of the label pitch LP. The periodicity analysis unit 61, in a period in which the image forming apparatus 1 is conveying the recording medium 9, based on the most recent label pitch data 54A, repeats the analysis operation.

(Operation of Write Output Timing Calculation Unit 62)

The write output timing calculation unit 62 uses the analysis results with respect to the periodicity of the label pitch LP that the periodicity analysis unit 61 analyzes, and calculates the timing for the each label 9A. Hereinafter, operations of the image forming apparatus 1, which includes the operation of the write output timing calculation unit 62, are described in detail.

Figure 13:
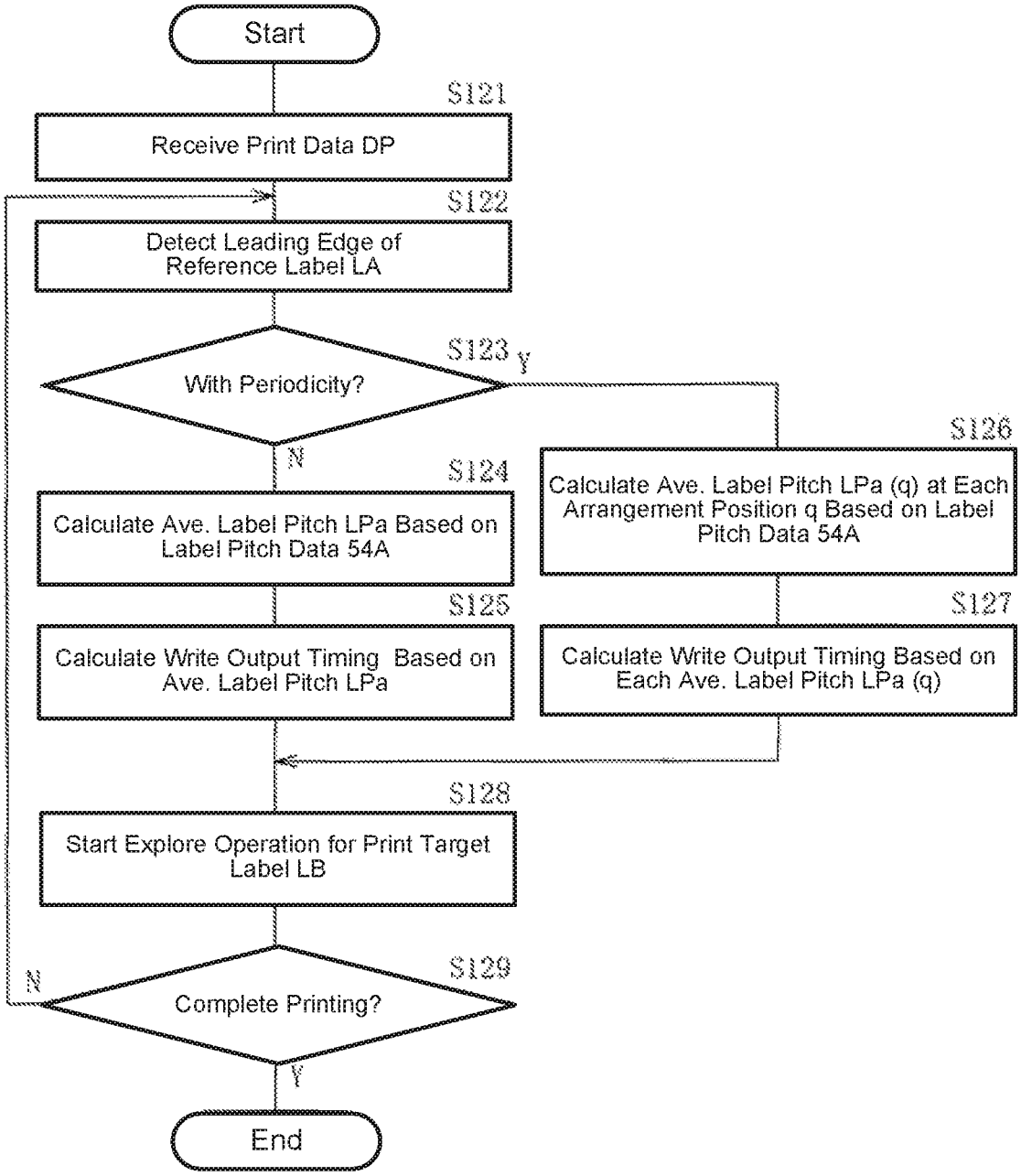
FIG. 13 is another flowchart illustrating an operation example of the image forming apparatus shown in FIG. 1

FIG. 13 shows an example of an image forming operation in the image forming apparatus 1. The write output timing calculation unit 62, at every time when the label sensor 36 detects the leading edge of the label 9A (reference label LA), calculates the write output timing of the target label LB according to the latest analysis results for the periodicity of the label pitch LP by the periodicity analysis unit 61. Hereinafter, this operation will be described in detail.

First, the image forming apparatus 1 receives the print data DP (step S121). Thus, the image forming apparatus 1 starts the conveyance of the recording medium 9.

Next, the label sensor 36 detects the leading edge of the label 9A (reference label LA) (step S122).

Next, the write output timing calculation unit 62 check the latest analysis result with respect to the periodicity of the label pitch LP, which is made by the periodicity analysis unit 61 (step S123). In the case of indicating that there is no periodicity ("N" in step S123), the write output timing calculation unit 62, on the basis of the label pitch data 54A, obtains an average label pitch LPa (step S124). Based on the average label pitch LPa, the write output timing calculation unit 62 calculates the timing out writing by utilizing Equation (4) (step S125). Further, in the case of indicating that there is a periodicity ("Y" in step S123), the write output timing calculation unit 62, on the basis of the label pitch data 54A, obtains the average label pitch LPa at each arrangement position q (q) (step S126). Based on their average label pitches LPa (q), the write output timing calculation unit 62 calculates the write output timing (step S127). Specifically, the write output timing calculation unit 62 obtains the distance LMS based on the average label pitches LPa (q) at each arrangement position q. On the basis of the distance LMS, the write output timing calculation unit 62 calculates the write output timing by utilizing Equation (3).

Next, LED heads 19 of the four image forming units 10, based on an instruction from the exposure control unit 66, starts the exposure operation for the print target label LB at the write output timing calculated by the write output timing calculation unit 62 (step S128).

Next, the image forming apparatus 1 checks whether or not, the printings for all of the labels 9A are completed (step S129). In the case of not completing the printings yet ("N" in step S129), it returns to step S122. The image forming apparatus 1 performs a processing for the next reference labels LA and the next print target label LB. In this manner, the image forming apparatus 1, until the printings for all of the labels 9A are completed, repeats the operation of steps S122~S129.

Then, when the printings for all of the labels 9A are completed ("Y" in step S129), this flow ends.

Figure 14:
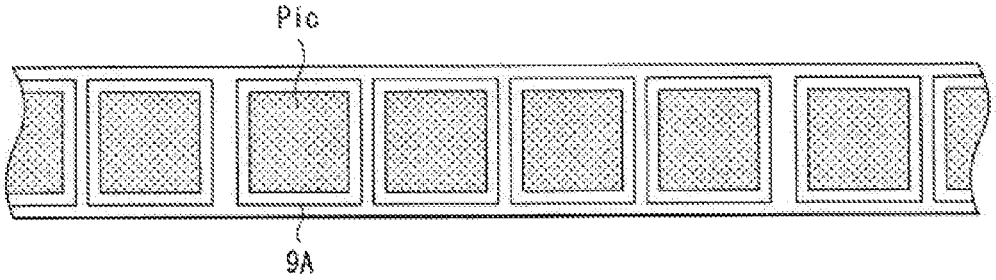
FIG. 14 is an explanatory diagram showing an example of an image forming result by the image forming apparatus shown in FIG. 1

FIG. 14 shows an example of a case of forming an image on a recording medium 92 having a periodicity in the label pitch LP. Thus, when there is periodicity in the label pitch LP, the image forming apparatus 1 calculates a write output timing by using the average label pitch LPa (q) at each arrangement position q. Thus, as shown in FIG. 14, it is possible to form an image Pic near the middle of each label 9A. That is, for example, in the case where there is periodicity in the label pitch LP, when calculating the write output timing by using the average label pitch LPa of all of labels 9A, the periodicity of the label pitch LP is not taken into account. There is a possibility that image Pic is formed at a position shifted from the center of each label 9A. On the other hand, since the image forming apparatus 1 calculates the write output timing by using the average label pitch LPa at each arrangement position q (q), a risk that the formed image is shifted from the position of the print target label LB is reduced. As a result, the image forming apparatus 1, as shown in FIG. 14, is able to form the image Pic near the middle of each label 9A.

[Advantage]

In the above manner, in this embodiment, since the write output timing is calculated in consideration of the periodicity of the label pitch, it became possible to form an image in a proper position.

In this embodiment, since the information about the label pitch is accumulated in the label pitch data, it is possible to analyze the periodicity of the label pitch on the basis of the label pitch data, it became passable to form an image in a proper position.

In this embodiment, on the basis of the label pitch data, the average label pitch LPa (q) at each arrangement position q is calculated, it became possible, on the basis of these average label pitches LPa (q), to calculate the write output timing. An image can be formed in a proper position.

[Modification 1]

In the above embodiment, the write output timing calculation unit 62, in the case where there is a periodicity in the label pitch LP, calculates the average label pitch LPa at each arrangement position q (q). The present invention is not limited thereto. The following describes in detail the image forming apparatus 1A according to modifications.

The image forming apparatus 1A includes an engine control unit 60A. The engine control unit 60A includes a write output timing calculation unit 62A. For example, as shown in FIGS. 8 and 9, in the case where there are small variations of the label pitches LP in the label set S and where a label pitch LP among the label set S is significantly different from another label pitch LP between two of the label sets S, the write output timing calculation unit 62A calculates the average value of label pitch LP among the label set S (average label pitch LPa1) and the average value of label pitch LP in the label set S (average label pitch LPa2). In the example of FIG. 11, the average label pitches LPa1 and LPa2 can be expressed by the following equations.

[Equation 9]

$$\left.\begin{aligned} LPa1 &= \frac{LP(4)+LP(8)+\ldots+LP(4+4Y)}{Y} \\ LPa2 &= \frac{LP(1)+LP(2)+LP(3)+LP(5)LP(6)+\ldots+LP(3+4Y)}{3Y} \end{aligned}\right\} \quad (9)$$

Then, the write output timing calculation unit 62A obtains that the label 9A (reference label LA) corresponds to which one of the arrangement positions q. Using the obtained arrangement position of the reference label LA and the average label pitches LPa1 and LPa2, the distance LMS is obtained.

Specifically, for example, when the reference label LA is a label PA that is positioned at the arrangement position of q=2, and when N is 7 (N=7), the print target label LB is, as shown in FIG. 11, is the label 9A arranged at the arrangement position of q=4. Therefore, at the timing of the label sensor 36 detecting the leading edge of the reference label LA, the distance LMS between the label sensor 36 and the leading edge of the print target label LB is expressed by the following equation.

[Equation 10]

$$LMS = LPa1 + 5 \times LPa2 \quad (10)$$

That is, in this example, from the leading edge of the reference label LA to the leading edge of the print target label LB, there is one label pitch LP between label sets S (label pitch LP (4)), and there are five label pitches LP that are in the label set S. Therefore, the write output timing calculation unit 62A uses the average label pitch LPa1, LPa2, and obtains the distance LMS with Equation (10). Then, the write output timing calculation unit 62A, based on the distance LMS, is able to obtain the write output timing.

Figure 15:
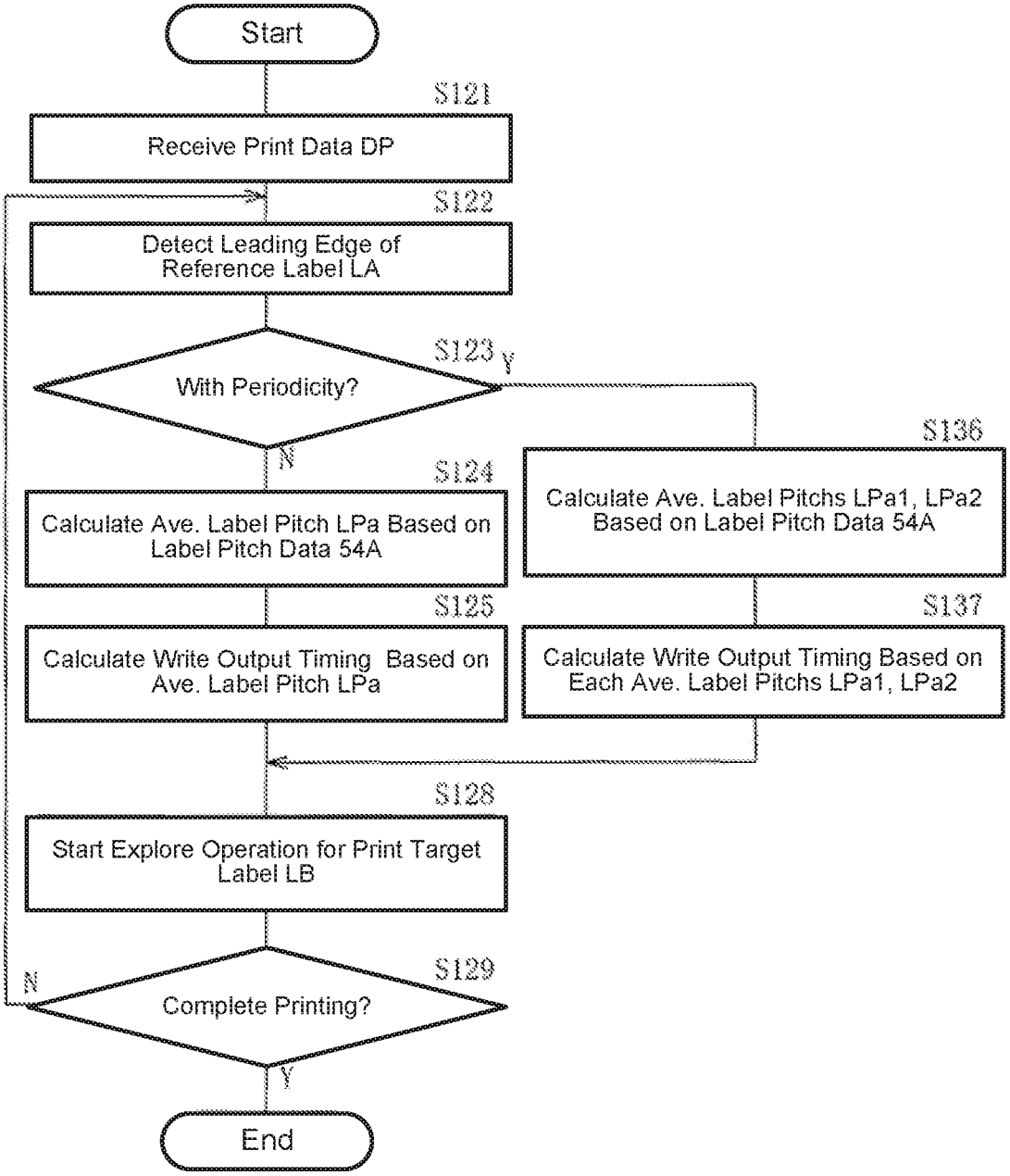
FIG. 15 is a flowchart illustrating an operation example of the image forming apparatus according to a modification.

FIG. 15 shows an example of an image forming operation in the image forming apparatus 1A. First, the image forming apparatus 1A receives the print data DP (step S121), the label sensor 36 detects the leading edge of the label 9A (reference label LA) (step S122).

Next, the write output timing calculation unit 62A confirms the latest analysis result with respect to the periodicity of the label pitch LP by the periodicity analysis unit 61 (step S123). When the analysis result indicates that there is no periodicity ("N" in step S123), the flow is the same as the above embodiment. Further, when the analysis result indicates that there is a periodicity ("Y" in step S123), the write output timing calculation unit 62A, based on the label pitch data 54A, obtains average label pitches LPa1, LPa2 (step S136), calculates the write output timing based on their average label pitches LPa1, LPa2 (step S137). Specifically, the write output timing calculation unit 62A obtains the distance LMS based on the average label pitches LPa1, LPa2, on the basis of this distance LMS, calculates the write output timing by utilizing Equation (3).

Next, the LED heads 19 of the four image forming units 10, based on an instruction from the exposure control unit 66, starts the exposure operation for the print target label LB at the write output timing calculated by the write output timing calculation unit 62A (step S128).

Next, the image forming apparatus 1A confirms whether the printings for all of the labels 9A are completed (step S129). In the case of not completing yet ("N" in step S129), it returns to step S122. In the case where the printings for all the labels 9A end ("Y" in step S129), this flow ends.

[Modification 2]

In the above embodiment, the periodicity analysis unit 61, in the case where data on the label pitch data 54A is insufficient ("N" in step S104), determines that there is no periodicity in the label pitch LP (step S109). In this case, the write output timing calculation unit 62, because there is no periodicity in the label pitch LP (in step S113 "N"), calculates the average label pitch LPa based on the label pitch data 54A (step S114), and calculates the write output timing on the basis of the average label pitch LPa. This technique is not limited thereto. Hereinafter, other modifications will be described in detail with some examples.

Figure 16:
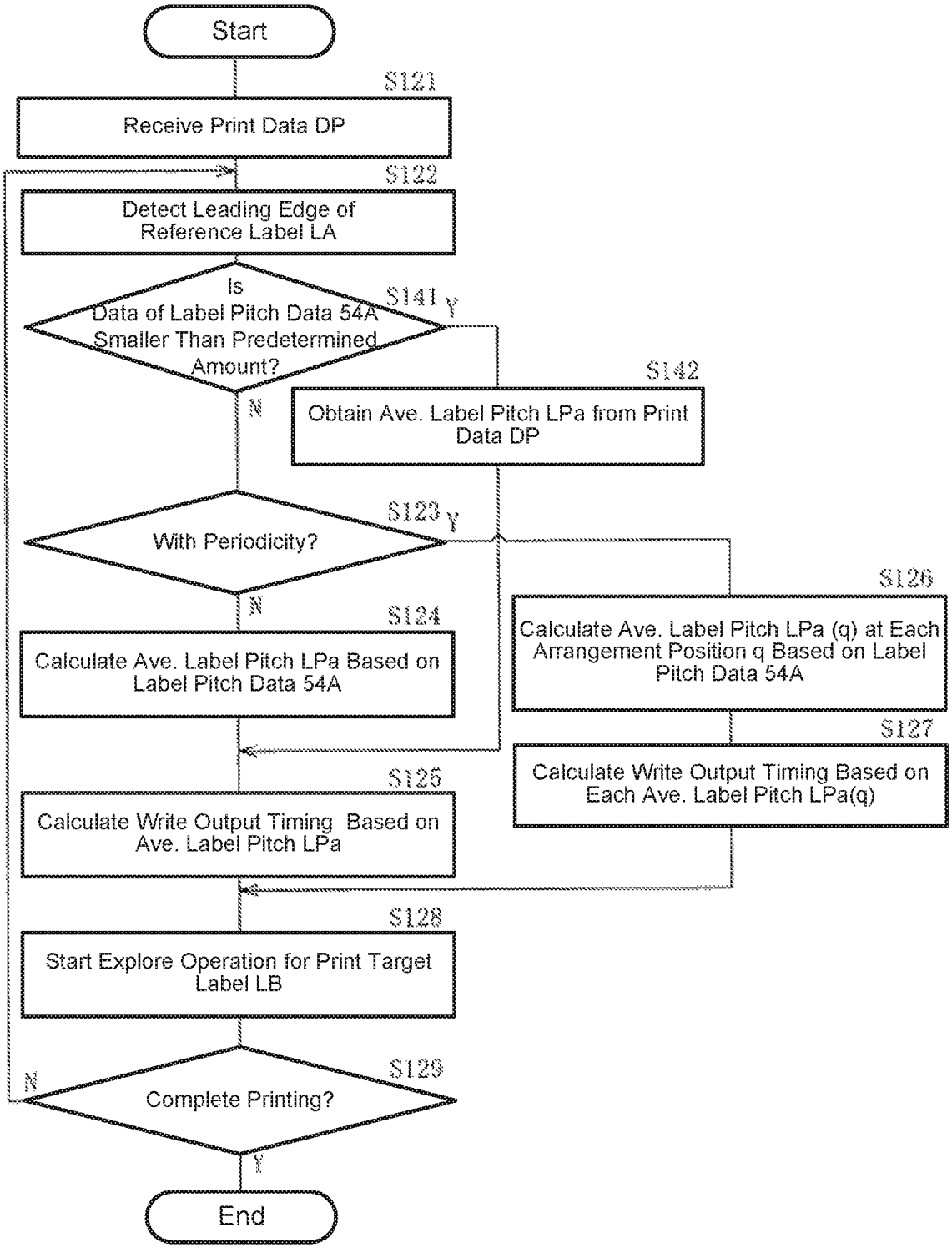
FIG. 16 is a flowchart illustrating an operation example of the image forming apparatus according to another modification.

FIG. 16 shows an example of an image forming operation in the image forming apparatus 1B according to the present modification.

After the label sensor 36 detects the leading edge of the label 9A (reference label LA) (step S122), the write output the timing calculation unit 62B of the image forming apparatus 1B confirms whether or not the data accumulated in the label pitch data 54A is less than a predetermined amount (step S141). In the case where the data accumulated in the label pitch data 54A is equal to or larger than the predetermined amount ("N" in step S141), it proceeds to step S123. The remaining steps are the same as in the above embodiment.

In step S141, in the case where the data accumulated in the label pitch data 54A is smaller than the predetermined amount ("Y" in step S141), the image forming apparatus 1B acquires information for the average label pitch LPa from the print data DP (step S142). That is, in this example, when generating the print data DP by operating the host computer, the user sets information about the average label pitch LPa. Thus, the print data DP includes the information about the average label pitch LPa. The image processing unit 55B of the image forming apparatus 1B acquires the information about the average label pitch LPa from the print data DP. Then, the image processing unit 55B supplies the information about the average label pitch LPa to the write output timing calculation unit 62B.

Then, the write output timing calculation unit 62B, based on the average label pitch LPa, calculates the write output timing by utilizing Equation (4) (step S125). The remaining steps are the same as in the above embodiment.

Thus, in the image forming apparatus 1B, for example, immediately after the roll of the recording medium 9 is installed, if the data (or the data amount) accumulated in the label pitch data 54A is small, the average label pitch LPa included in the print data DP is useful to calculate the write output timing as the initial value, it is possible to form the image at a proper position.

In this example, the information about the average label pitch LPa is set by the user operating the host computer, but it is not limited thereto. Alternatively, for example, by the user operating the operation unit 52 of the image forming apparatus 1, the average label pitch LPa may be set.

Figure 17:
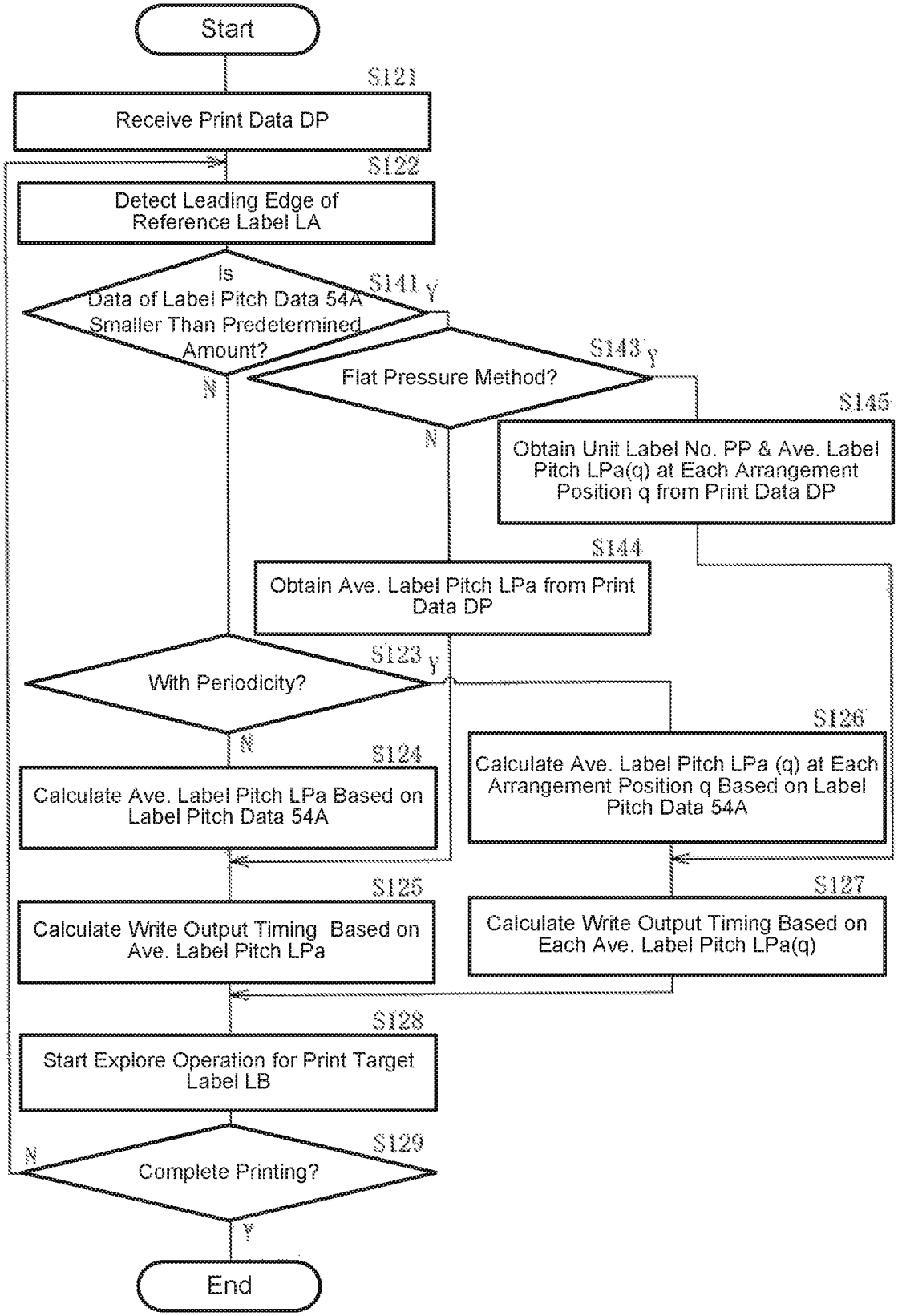
FIG. 17 is a flowchart illustrating an operation example of the image forming apparatus according to another modification.

FIG. 17 shows an example of an image forming operation in other image forming apparatus 1C according to the present modification.

After the label sensor 36 detects the leading edge of the label 9A (reference label LA) (step S122), the write output timing calculation unit 62C of the image forming apparatus 1C confirms whether or not the data accumulated in the label pitch data 54A is less than a predetermined amount (step S141). In the case where the data accumulated in the label pitch data 54A is equal to or larger than the predetermined amount ("N" in step S141), it proceeds to step S123. The remaining steps are the same as in the above embodiment.

In step S141, in the case where the data accumulated in the label pitch data 54A is smaller than the predetermined amount ("Y" in step S141), the image forming apparatus 1C acquires, from the print data DP, parameters (manufacturing parameters) for the manufacturing method of the recording medium 9 (step S143). That is, in this example, when the use generates the print data DP by operating the host computer, the manufacturing parameters are set. The manufacturing parameters are, for example, selected from one of among the plurality of manufacturing methods including "rotary method" and "flat pressure method." Further, for example, when the user selects the "rotary method," the information about the average label pitch LPa is expected to be set. In this case, the print data DP includes a manufacturing parameter indicating the "rotary method" and the information about the average label pitch LPa. Further, for example, when the user selects the "flat pressure method," information about the unit label number PP and the average label pitches LPa (q) at the every arrangement position q are expected to be set. In this case, the print data DP includes a manufacturing parameter that indicates a "flat pressure method" and the information about the unit label number PP and the average label pitches LPa (q) at the every arrangement position q. The image processing unit 55C of the image forming apparatus 1C acquires a manufacturing parameter from the print data DP. The image processing unit 55C supplies the manufacturing parameter to the write output timing calculation unit 62C.

In step S143, in the case where the manufacturing parameters shows "rotary method" ("N" in step S143), the write output timing calculation unit 62C, from the print data DP, obtains information about the average label pitch LPa (step S144). Specifically, the image processing unit 55C, from the print data DP, obtains the information about the average label pitch LPa, and supplies the information to the write out timing calculation unit 62C. Then, the write output timing calculation unit 62C, based on the average label pitch LPa, calculates the write output timing using Equation (4) (step S125). The remaining steps are the same as in the above embodiment.

Further, in step S143, in the case where the manufacturing parameters shows "flat pressure method" ("Y" in step S143), the write output timing calculation unit 62C, from the print data DP, obtains information about the unit label number PP and the average label pitches LPa (q) at the each arrangement position q (step S145). Specifically, the image processing unit 55C, from the print data DP, obtain the information about the unit label number PP and the average label pitch LPa (q) at the every arrangement position q, and supplies the information to the write output timing calculation unit 62C. Then, the write output timing calculation unit 62C, based on the unit label number PP and the average label pitch LPa (q) at the every arrangement position q, calculates a write output timing using Equation (3) (step S127). The remaining steps are the same as in the above embodiment.

In this example, by the user operating the host computer, information about the manufacturing parameters, the average label pitch LPa, LPa (q), and the unit label number PP are set. The present invention is not limited thereto. Alternatively, for example, by the user operating the operation unit 52 of the image forming apparatus 1, these parameters may be set.

Figure 18:
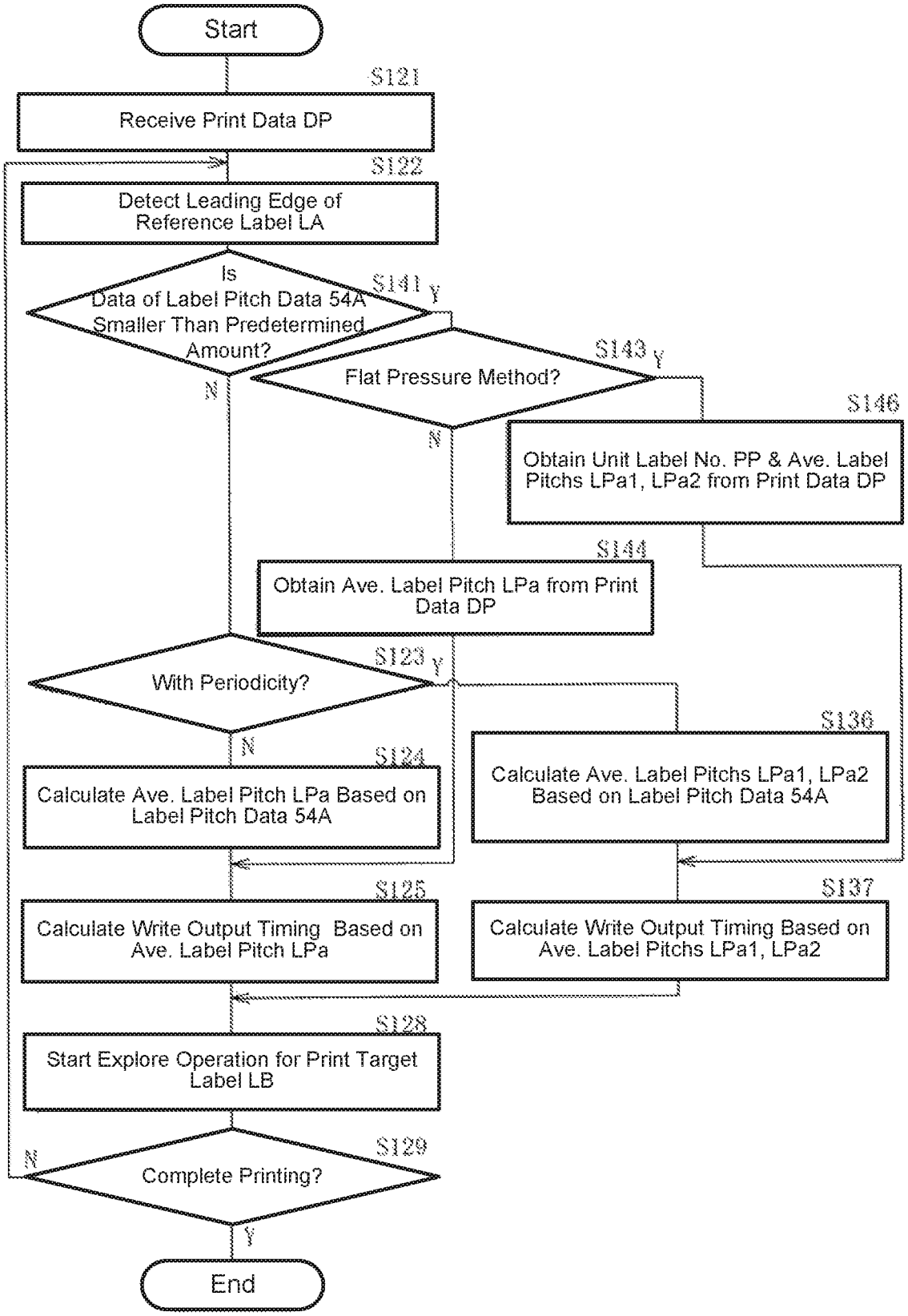
FIG. 18 is a flowchart illustrating an operation example of the image forming apparatus according to another modification.

FIG. 18 shows an example of an image forming operation in the other image forming apparatus 1D according to the present modification. The image forming apparatus 1D is a modification to which the above modification of the image forming apparatus 1A (FIG. 15) is applied.

After the label sensor 36 detects the leading edge of the label 9A (reference label LA) (step S122), the write output timing calculation unit 62D of the image forming apparatus 1D confirms whether or not data accumulated in the label pitch data 54A is less than a predetermined amount (step S141). In the case where the data accumulated in the label pitch data 54A is equal to or larger than the predetermined amount ("N" in step S141), it proceeds to step S123. The remaining steps are the same as in the image forming apparatus 1A.

In step S141, in the case where the data accumulated in the label pitch data 54A is smaller than the predetermined amount ("Y" in step S141), the image forming apparatus 1D, from the print data DP, obtains parameters of manufacturing parameters for the manufacturing method of the recording medium 9 (step S143). That is, in this example, when the user generates the print data DP by operating the host computer, the manufacturing parameters are set. For example, when the user selects "flat pressure method,", the information of the unit label number PP and average label pitches LPa1, LPa2 are expected to be set. In this case, the print data DP includes a manufacturing parameter that indicates a "flat pressure method" and the information of the unit label number PP and average label pitches LPa1, LPa2. The image processing unit 55D of the image forming apparatus 1D acquires the manufacturing parameters from the print data DP. The image processing unit 55D supplies the manufacturing parameters to the write output timing calculation unit 62D.

In step S143, in the case where the manufacturing parameters show the "rotary method" ("N" in step S143), the write output timing calculation unit 62D, from the print data DP, obtains information about the average label pitch LPa (step S144). Specifically, the image processing unit 55D, from the print data DP, obtains the information about the average label pitch LPa, and supplies the information to the write out timing calculation unit 62D. Then, the write output timing calculation unit 62D, based on the average label pitch LPa, calculates the write output timing using Equation (4) (step S125). The remaining steps are the same as in the image forming apparatus 1A.

Further, in step S143, in the case where the manufacturing parameters shows the "flat pressure method" ("Y" in step S143), the write output timing calculation unit 62D, from the print data DP, obtains the information about the unit label number PP and average label pitches LPA1, LPA2 (step S145). Specifically, the image processing unit 55D, from the print data DP, obtain the information about the unit label number PP and average label pitch LPa (q) at the every arrangement position q, and supplies the information to the write output timing calculation unit 62D. Then, the write output timing calculation unit 62D, based on the unit label number PP and average label pitches LPA1, LPA2, calculates the write output timing using Equation (3) (step S137). The remaining steps are the same as in the image forming apparatus 1A.

In this example, by the user operating the host computer, the information about the manufacturing parameters, average label pitches LPa, LPA1, LPA2, and the unit label number PP are set. The present invention is not limited thereto. Alternatively, for example, by the user operating the operation unit 52 of the image forming apparatus 1, these parameters may be set.

[Modification 3]

In the above embodiment, to analyze the periodicity of the label pitch LP, was calculated write out timing on the basis of the analysis result. The present invention is not limited thereto. Alternatively, for example, to analyze the periodicity of the label interval LS, may be calculated write output timing on the basis of the analysis result. It will be described in detail the modification below.

Figure 19:
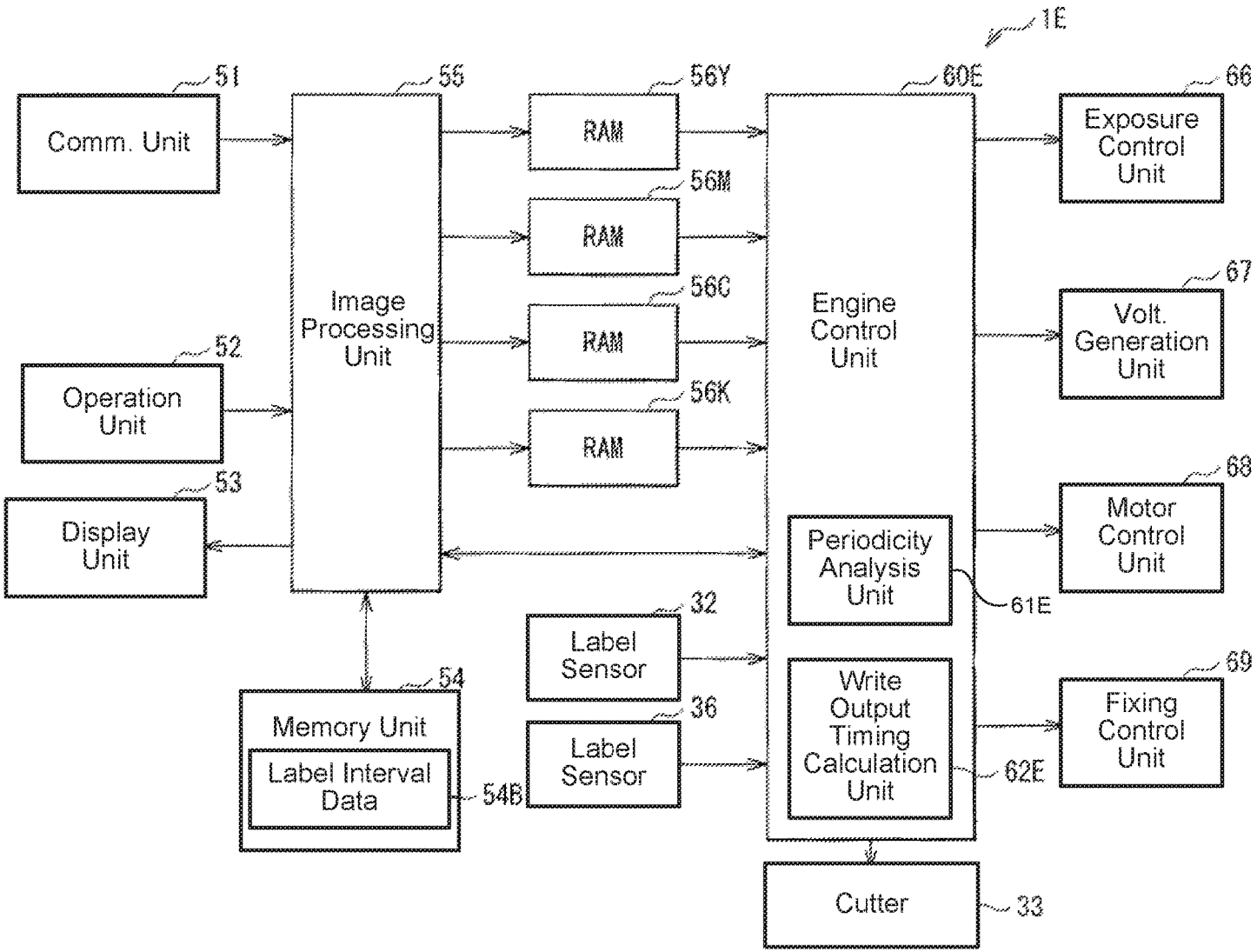
FIG. 19 is a block diagram showing an example of a control mechanism of the image forming apparatus according to another modification.

FIG. 19 shows an example of a control mechanism in the image forming apparatus 1E according to this modification. The image forming apparatus 1E includes a memory unit 54, and an engine control unit 60E.

The memory unit 54 stores label interval data 54B also. In the label interval data 54B, stored is information about the label interval LS acquired at timing when an image formation is performed using a roll of recording medium 9 that is currently set in the image forming apparatus 1.

The engine control unit 60E has a periodicity analysis unit 61E and a write output timing calculation unit 62E.

The periodicity analysis unit 61E, on the basis of the stored label interval data 54B in the memory unit 54, analyzes the periodicity of the label interval LS. For example, in the example of the recording medium 91 manufactured by a rotary method (FIG. 7), the variation (or range of fluctuations) of the label interval LS is relatively small, there is no clear periodicity. On the other hand, in the example of the recording medium 92 manufactured by a flat pressure method (FIGS. 8 and 9), the variation of the label interval LS is relatively large, there is a periodicity found in the label interval LS. The periodicity analysis unit 61E, on the basis of the label interval data 54B stored in the memory unit 54, obtains the information about the periodicity of the label interval LS.

The write output timing calculation unit 62E, based on the analysis result of the periodicity analysis unit 61E, calculates the write output timing at which a toner image is transferred at the proper position of the label 9A in the secondary transfer unit 28.

Figure 20:
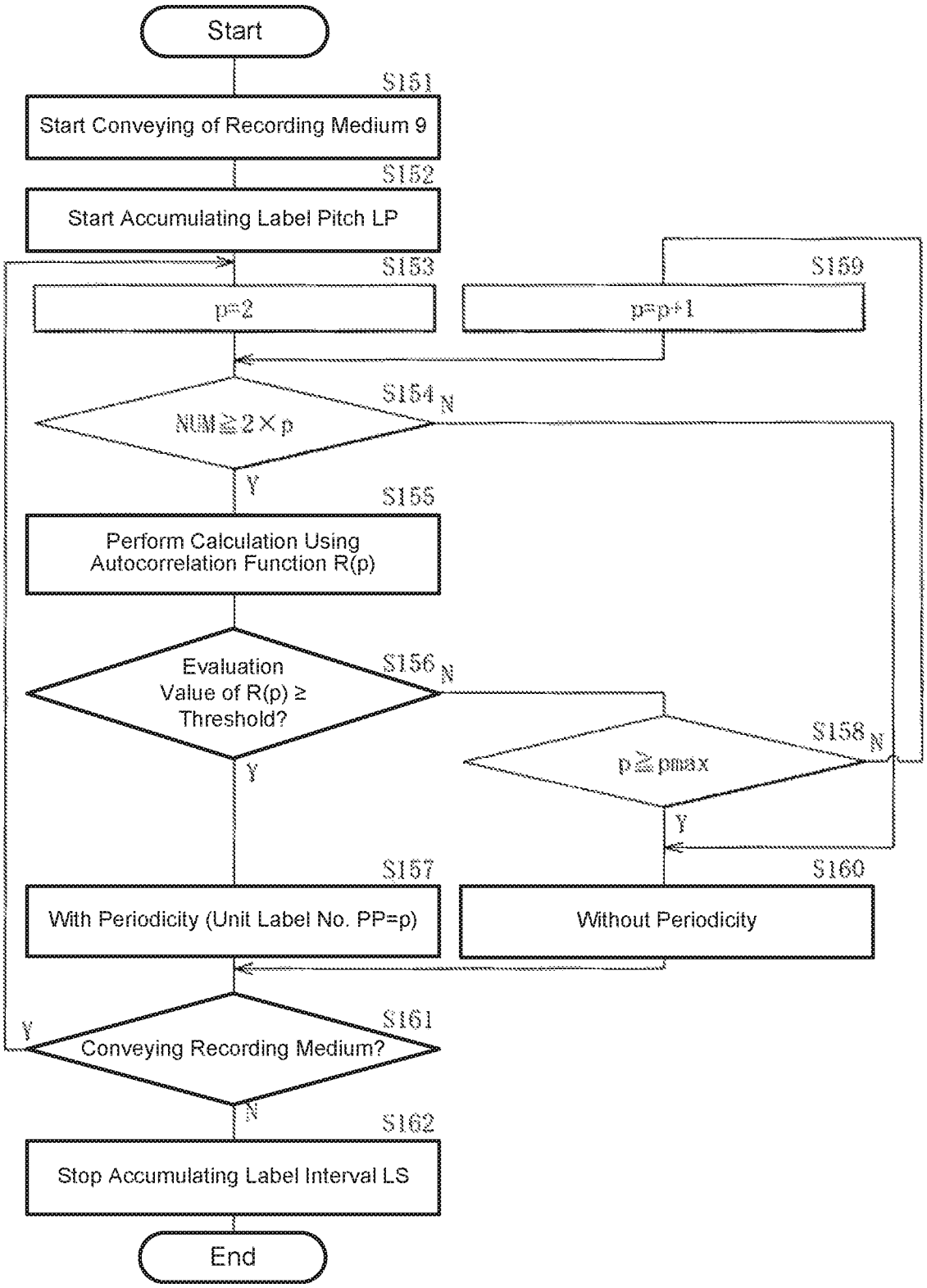
FIG. 20 is a flowchart illustrating an operation example of the image forming apparatus shown in FIG. 19.

FIG. 20 shows an example of an operation for analyzing the periodicity of the label interval LS in the image forming apparatus 1E. When the print data DP is supplied and the image forming apparatus 1E starts conveying the recording medium 9 (step S151), the image forming apparatus 1E starts accumulating label interval LS (step S152). Specifically, the engine control unit 60E, based on the output voltage of the label sensor 36, detects the leading edge of each label 9A, obtains the label interval LS based on the detection result. Then, the engine control unit 60E supplies information about the label interval LS to the memory unit 54 via the image processing unit 55, and accumulates the information in the label interval data 54B. Thereafter, the image forming apparatus 1 continues to accumulate the label interval LS.

Next, the periodicity analysis unit 61E has a parameter p "2" is set to (p=2) (step S153).

Next, the periodicity analysis unit 61, the data number NUM label interval LS included in the label interval data 54B confirms whether more than double the parameters p (NUM≥2×p) (step S154). If the data number NUM is less than twice the parameter p in ("N" in step S154), the periodicity analysis unit 61E determines that the data is missing on the label interval data 54B. In this example, the periodicity analysis unit 61E determines that there is no periodicity in the label interval LS (step S160), the process proceeds to step S161.

In step S154, when the data number NUM is twice or more than twice as large as the parameter p ("Y" in step S154), the periodicity analysis unit 61 determines that the label interval data 54B has enough amount of data numbers that are necessary for analyzing, and performs the calculation using the autocorrelation function R (p) based on the label interval data 54B (step S155).

Next, the periodicity analysis unit 61E confirms whether or not the evaluation value of the autocorrelation function R (p) is equal to or greater than a predetermined threshold value (step S156). If the evaluation value of the autocorrelation function R (p) is equal to or greater than the predetermined threshold value ("Y" in step S156), the periodicity analysis unit 61E determines that there is periodicity the label interval LS. In the periodicity, the number indicated by the parameter p is the unit label number PP (step S157). Then, it proceeds to step S161.

Further, in step S156, in the case where the evaluation value of the autocorrelation function R (p) is less than the predetermined threshold value ("N" in step S156), it is confirmed whether or not a parameter p is equal to or more than a value pmax (step S158). If the parameter p is less than the value pmax, ("N" in step S158), it increments the parameter p (step S159), proceeding to step S154. Further, if the parameter p is equal to or more than the value pmax ("Y" in step S158), the periodicity analysis unit 61 determines that there is no periodicity in the label interval LS because the evaluation value of the autocorrelation function R (p) in any parameter p is less than a predetermined threshold (step S160). Then, it proceeds to step S161.

Next, the engine control unit 60E checks whether the image forming apparatus 1E is still conveying the recording medium 9 (step S161). In the case where the image forming apparatus 1 is still conveying the recording medium 9 ("Y" in step S161), the process returns to step S153, and repeats the flow. The image forming apparatus 1E is the case ("N" in step S161), which stops the conveyance of the recording medium 9, the image forming apparatus 1E stops the accumulation of label interval LS (step S162).

In the above, this flow ends.

Figure 21:
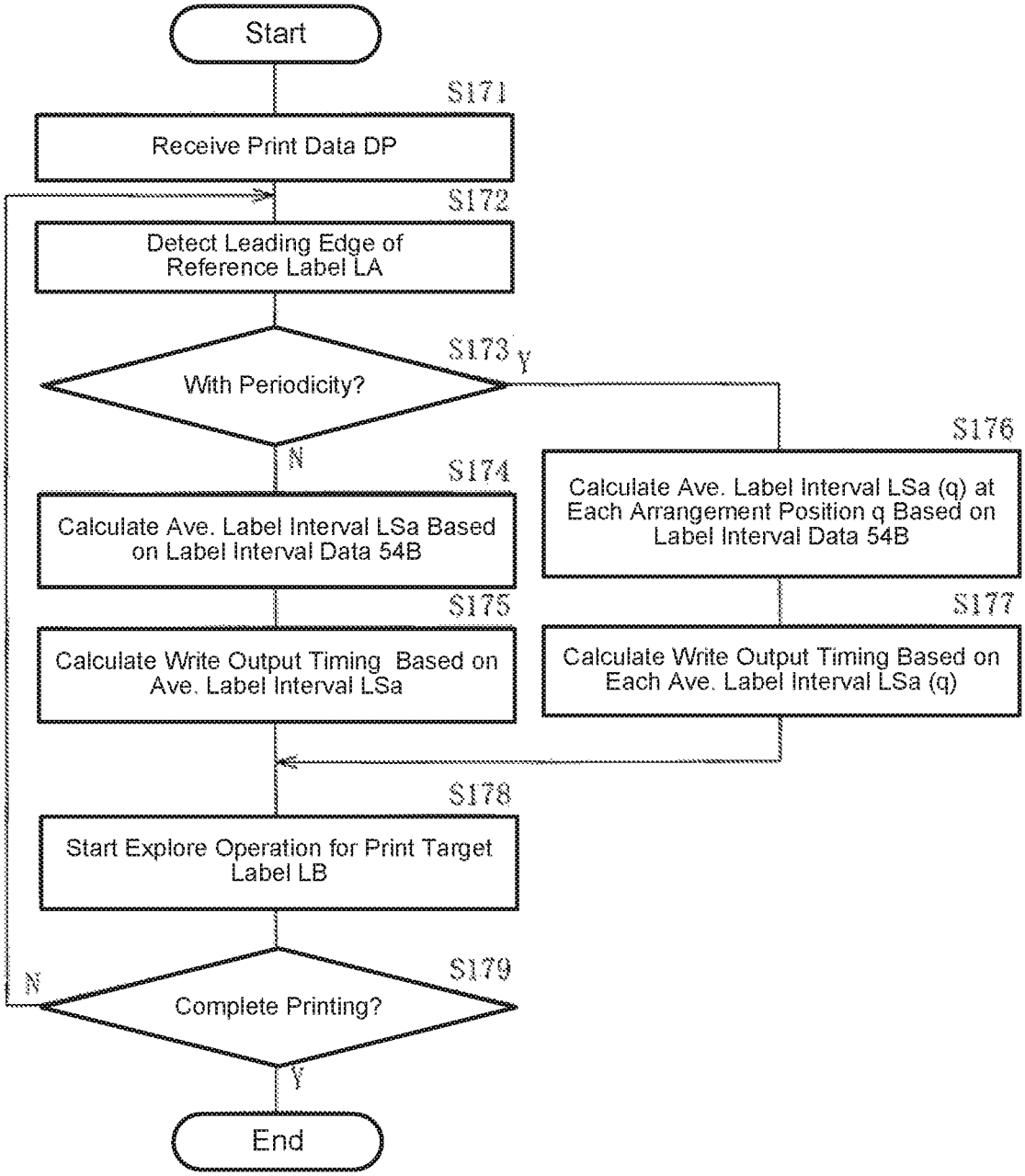
FIG. 21 is another flowchart illustrating an operation example of the image forming apparatus shown in FIG. 19.

FIG. 21 shows an example of an image forming operation in the image forming apparatus 1E. First, the image forming apparatus 1E receives print data DP (step S171). Thus, the image forming apparatus 1E starts conveying the recording medium 9. Next, the label sensor 36 detects the leading edge of the label 9A (reference label LA) (step S172).

Next, the write output timing calculation unit 62E is about the periodicity of the label interval LS, it confirms the latest analysis result of the periodicity analysis unit 61E (step S173). Analysis result, in the case indicating that there is no periodicity ("N" in step S173), the write output timing calculation unit 62E, based on the label interval data 54B, to determine the average label interval LSa (step S174) Ru. Based on the average label interval LSa and label length LL, the write output timing calculation unit 62E is calculating the write output timing (step S175). Further, the analysis result, in the case indicating that there is periodicity ("Y" in step S173), the write output timing calculation unit 62E, based on the label interval data 54B, the average label interval LSa at each arrangement position q (q) the calculated (step S176), it calculates the write output timing based on their average label interval LSa (q) (step S177). Specifically, the write output timing calculation unit 62E calculates the distance LMS based on the average label interval LSa (q) and the label length LL of each arrangement position q, on the basis of the distance LMS, calculates a write output timing.

Next, LED heads 19 of the four image forming units 10, based on an instruction from the exposure control unit 66, at the write output timing calculated by the write output timing calculation unit 62E, starts the exposure operation for the print target label LB (step S178).

Next, the image forming apparatus 1E confirms whether or not printings for all labels 9A are completed (step S179). In the case where the printings are not yet completed ("N" in step S179), it returns to step S172, the image forming apparatus 1E performs another processing for the next reference labels LA and the next print target label LB.

Then, when the printings of all the label 9A end ("Y" in step S179), the flow ends.

[Other Modifications]

When the invention is realized, a combination of two or more of these variations may be practical.

Explained is the present technology by embodiments and some variations. This technique is not limited to these embodiments, and various modifications are possible.

For example, in the above described embodiments, the toner image formed by the image forming unit 10 is transferred to the intermediate transfer belt 22, then the toner image transferred to the intermediate transfer belt 22 is transferred to the recording medium 9. The present invention is not limited thereto. Alternatively, for example, a toner image formed by the image forming unit 10 may be transferred directly to the recording medium 9.

Further, in the above described embodiments, a color image is formed on recording medium 9, the invention is not limited thereto. The present invention may form a monochrome image.

LEGENDS

1, 1A, 1B, 1C, 1D, 1E . . . image forming apparatus,
8 . . . conveying path,
9 . . . recording medium,
9A . . . labels,
9B . . . base sheet
9C . . . label side,
10, 10Y, 10M, 10C, 10K . . . image forming unit,
11, 11Y . . . photosensitive body,
12 . . . charge roller,
13 . . . developing roller,
14 . . . sponge roller,
16 . . . developing blade,
17 . . . cleaning blade,
18 . . . toner container,
19, 19Y . . . LED head,
21 . . . primary transfer roller,
22 . . . intermediate transfer belt,
23 . . . driving roller,
24 . . . idle roller,
25 . . . tension roller,
26 . . . backup roller,
27 . . . secondary transfer roller,
28 . . . secondary transfer unit,
31 . . . medium supply roller,
32 . . . label sensor,
32A . . . light emitting unit,
32B . . . receiving unit,
33 . . . cutter,
34, 35 . . . conveying roller,
36 . . . label sensor,
39 . . . media guide,
41 . . . fixing roller,
42 . . . pressing roller,
43 . . . heater,
51 . . . communication unit,
52 . . . operation unit,
53 . . . display unit,
54 . . . memory unit,
54A . . . label pitch data,
54B . . . label interval data,
55 . . . image processing unit,
56, 56Y, 56M, 56C, 56K . . . RAM,
60, 60E . . . engine control unit,
61, 61E periodicity analysis unit,
62, 62E . . . write output timing calculation unit,
66 . . . exposure control unit,
67 . . . voltage generation unit,
68 . . . motor control unit,
69 . . . fixing control unit,
90 . . . rewinder,
DP . . . print data,
F1 . . . conveying direction,
F2 . . . traveling direction,
LA . . . reference label,
LB . . . print target label,
LHT, LMS, LST . . . distance,
LL . . . label length,
LP . . . label pitch,
LPa, LPa1, LPa2, LPa ( ) . . . average label pitch,
LS . . . label interval,
LSa, LSa (q) . . . average label interval,
p . . . parameters,
Pic . . . image,
PP . . . unit label number,
q . . . arrangement position.

What is claimed is:

1. An image forming apparatus comprising:

a conveying unit that conveys a recoding medium on which a plurality of labels are placed in a conveying direction, a sensor that detects the labels on the recording medium, and provides detection results for each of the labels an image forming unit that performs an image forming process to form an image on one of the labels based on the detection results by the sensor, the image being formed at an image forming position, and a control unit that adjusts the image forming position of the image by synchronizing with a periodicity of label pitches (LS) based on the detection results by the sensor, wherein the periodicity of label pitches repeatedly occurs at an every label set (S), the label set is formed with two or more of the labels that are continuously arranged, and each of the label pitches is a distance between one leading edge of one label and another leading edge of another label following the one label, these labels adjoining in the conveying direction.

2. The image forming apparatus of claim 1, wherein the plurality of labels includes a first label and a second label, the second label being positioned at an upstream side with respect to the first label in the conveying direction, the control unit determines an operation start timing for the second label based on the periodicity of label pitches and the detection results for the first label by the sensor, and the control unit starts the image forming process for the second label at the operation start timing for the second label.

3. The image forming apparatus of claim 2, wherein the plurality of labels are grouped into plural label groups each of which corresponds to the periodicity of label pitches so that one group includes a predetermined number of labels, the predetermined number of labels in each of the groups are placed at arrangement positions that are designed for the predetermined number, the control unit determines the operation start timing for the second label in further consideration of an arrangement position for the first label and an arrangement position for the second label in the plural label groups.

4. The image forming apparatus of claim 3, wherein the control unit determines the operation start timing for the second label in further consideration of a first average value of a label pitch corresponding to a third label and a second average value of a label pitch corresponding to any other labels except for the third label, the third label being placed at a predetermined arrangement position in each of the label groups among the plurality of labels detected by the sensor.

5. The image forming apparatus of claim 3, wherein the arrangement position includes a first arrangement position and a second arrangement position, the control unit obtains a first average value of a label pitch corresponding to a label that is placed at the first arrangement position among the plurality of labels detected by the sensor, and a second average value of a label pitch corresponding to another label that is placed at the second arrangement position among the plurality of labels detected by the sensor, and the control unit determines the operation start timing for the second label in further consideration of the first average value and second average value.

6. The image forming apparatus of claim 3, wherein a label pitch that corresponds to a third label placed at a predetermined arrangement position among the predetermined number of labels belonging to each of the label groups is longer than one or more than one label pitches that correspond to one or plural labels that are any other label expect for the third label among the predetermined number of labels.

7. The image forming apparatus of claim 3, wherein a label pitch that corresponds to a third label placed at a predetermined arrangement position among the predetermined number of labels belonging to each of the label groups is shorter than one or more than one label pitches that correspond to one or plural labels that are any other label except for the third label among the predetermined number of labels.

8. The image forming apparatus of claim 2, further comprising:

an operation unit that receives setting information about the label pitch, wherein the control unit uses a setting unit as a default setting, determining the operation start timing for the second label.

9. The image forming apparatus of claim 8, wherein the setting information includes information about a manufacturing method of the recording medium.

10. The image forming apparatus of claim 3, further comprising:

a receiving unit that receives setting information about the label pitch, wherein the control unit uses a setting unit as a default setting, determining the operation start timing for the second label, and the setting information includes information about the predetermined number.

11. The image forming apparatus of claim 8, wherein the plurality of labels are grouped into plural label groups each of which corresponds to the repeating unit, and the setting information includes information about a label pitch corresponding to a third label placed at a predetermined arrangement position in each of the label groups among the plurality of labels, and information about other plural label pitches corresponding to any other labels except for the third label among the plurality of labels.

12. The image forming apparatus of claim 8, wherein the plurality of labels are grouped into plural label groups each of which corresponds to the repeating unit, the predetermined number of labels in each of the groups are placed at arrangement positions that are designed for the predetermined number, the arrangement positions includes a first arrangement position and a second arrangement position, the setting information includes information about a label pitch corresponding to a label placed at the first arrangement position among the plurality of labels, and information about a label pitch corresponding to a label placed at the second arrangement position among the plurality of labels.

13. The image forming apparatus of claim 8, wherein the setting information includes information about a label pitch of the plurality of the labels.

14. The image forming apparatus of claim 1, further comprising:

a memory unit, wherein the control unit obtains a plurality of the label pitches by sequentially determining the label pitches between two of the labels adjoining among the plurality of the labels, and accumulates these label pitches in the memory unit, and calculates the cycle of label pitch based on these label pitches.

15. The image forming apparatus of claim 4, wherein each of the label pitches includes a label length of a fourth label corresponding to one label pitch, and a label interval that is determined between the fourth label and a fifth label adjoining to the fourth label.

16. An image forming apparatus comprising:

a conveying unit that conveys a recoding medium on which a plurality of labels are placed in a conveying direction, a sensor that detects the labels on the recording medium, and provides detection results for each of the labels, an image forming unit that performs an image forming process to form an image on one of the labels based on the detection results by the sensor, the image being formed at an image forming position, and a control unit that adjusts the image forming position of the image by synchronizing with a periodicity of label intervals (LS) based on the detection results by the sensor, wherein the periodicity of label intervals occurs at an every label set (S), the label set is formed with two or more of the labels that are continuously arranged, and each of the label intervals is a distance between a trailing edge of one label and a leading edge of another label following the one label, these labels adjoining in the conveying direction.

* * * * *